US006530569B2

(12) United States Patent
Yamagishi

(10) Patent No.: US 6,530,569 B2
(45) Date of Patent: Mar. 11, 2003

(54) SHEET CONVEYING DEVICE AND IMAGE FORMING APPARATUS INCLUDING THE SAME

(75) Inventor: Masaru Yamagishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 09/813,784

(22) Filed: Mar. 22, 2001

(65) Prior Publication Data

US 2001/0054787 A1 Dec. 27, 2001

(30) Foreign Application Priority Data

Mar. 22, 2000 (JP) ..... 2000-079625
Sep. 22, 2000 (JP) ..... 2000-289053
Feb. 16, 2001 (JP) ..... 2001-039989

(51) Int. Cl.[7] ..... B65H 5/34
(52) U.S. Cl. ..... 271/270
(58) Field of Search ..... 271/270, 3.18, 271/3.19, 3.2, 256, 258, 259, 264, 266; 399/396; 198/792

(56) References Cited

U.S. PATENT DOCUMENTS 4,331,328 A * 5/1982 Fasig ..... 271/270
4,451,027 A * 5/1984 Alper ..... 271/10.02
5,365,323 A * 11/1994 Ando ..... 399/367
5,423,527 A * 6/1995 Tranquilla ..... 271/10.02
5,461,468 A * 10/1995 Dempsey et al. ..... 399/396
5,692,742 A * 12/1997 Tranquilla ..... 271/10.03
5,737,682 A 4/1998 Yamagishi
5,785,312 A * 7/1998 Krupica et al. ..... 271/264
6,154,621 A * 11/2000 Yamamoto et al. ..... 399/68

FOREIGN PATENT DOCUMENTS

JP 8-217291 8/1996
JP 11-020993 1/1999

OTHER PUBLICATIONS

U.S. patent application Ser. No. 09/813,784, filed Mar. 2001.*
U.S. patent application Ser. No. 10/119,835, filed Apr. 2002.*

* cited by examiner

*Primary Examiner*—Donald P. Walsh
*Assistant Examiner*—Kenneth W Bower
(74) *Attorney, Agent, or Firm*—Oblon, Spivak, McClelland, Maier & Neustadt, P.C.

(57) ABSTRACT

A sheet conveying device includes conveying means respectively located at an upstream side and a downstream side on a sheet conveyance path. First drive means rotates the upstream conveying means at a constant speed while second drive means rotates the downstream conveying means at a variable speed. When the second drive means accelerates the rotation of the downstream conveying means, speed adjusting means causes the conveying speed of the upstream conveying means to reflect the acceleration. The sheet conveying device insures smooth, reliable conveyance even when a sheet extends over both of the upstream and downstream conveying means.

49 Claims, 20 Drawing Sheets

SHEET CONVEYING DEVICE AND IMAGE FORMING APPARATUS INCLUDING THE SAME

BACKGROUND OF THE INVENTION

The present invention relates to an image forming apparatus and more particularly to a sheet conveying device, a drive control device and a duplex copy unit included in an image forming apparatus as well as to a sheet conveying method and a drive control method.

It is a common practice with a sheet conveying device to drive conveying means respectively located at the upstream side and downstream side in a direction of sheet conveyance by use of a single drive means or respective drive means. Assume that the upstream conveying means rotates to convey a sheet at a speed of u1, that the downstream conveying means rotates to convey it at a speed of u2 equal to u1, and that the two conveying means rotating at such a speed are accelerated. Also, assume that the drive means respectively assigned to the upstream and downstream conveying means are controllable independently of each other. Then, when a sheet extends over both of the two conveying means, the two drive means may be accelerated at the same time. Further, assume that a usual conveying speed before acceleration and a conveying speed after acceleration are up and uk, respectively. Then, the sheet can be surely accelerated if u1 is equal to uK and if u2 is equal to uK.

On the other hand, assume that either one of the upstream and downstream drive means is controlled in speed. For example, assume that the upstream conveying means rotates at a constant speed while the downstream conveying speed is accelerated. Then, the downstream drive means is so controlled as to accelerate the downstream conveying means when a sheet extends over both of the upstream and downstream conveying means. At the same time, the upstream drive means and upstream conveying means are connected via a one-way clutch such that the upstream conveying means follows the rotation of the downstream conveying means. As a result, despite that the conveying speed u2 is higher than the conveying speed u1 (u1=up and u2=uK), the difference in conveying speed between the two conveying means can be absorbed, insuring acceleration.

The requisite with a modern copier, printer, facsimile apparatus, plotter or similar image forming apparatus is high productivity or printing efficiency. To meet this requisite, the conveying speed of, e.g., a duplex copy conveying unit, peripheral unit or paper discharge unit is increasing relative to the conveying speed or process speed of an image forming section. Particularly, an image forming apparatus operable in a duplex copy mode is required to reverse a paper sheet or similar sheet carrying an image on one side thereon with a duplex copy conveying device and again feed it to an image forming section. A higher speed conveying speed is therefore essential with this type of apparatus.

Today, in parallel with the digitization of an image forming apparatus, interleaf control is becoming predominant. The Interleaf control is such that while sheets are constantly conveyed along the path of an image forming apparatus, the feed of sheets from a tray and the refeed of sheets from a duplex copy conveying unit are alternately effected. Therefore, an image forming apparatus with the interleaf control capability does not need an intermediate tray for temporarily stacking sheets.

Japanese Patent Laid-Open Publication No. 63-112626 and Japanese Patent No. 2,846,926, for example, each disclose a particular sheet conveying device for an image forming apparatus. The sheet conveying device taught in Laid-Open Publication No. 63-112626 includes a single drive means for rotating a plurality of conveying means arranged in a duplex copy conveying unit. The sheet conveying device reverses a sheet and then accelerates the sheet as far as a registration roller pair. The sheet conveying device proposed in Patent No. 2,846,926 includes drive means each being assigned to upstream conveying means and downstream conveying means. The drive means allow a sheet to be conveyed at a variable speed in accordance with the condition of conveyance. This is directed toward smooth acceleration and deceleration to be effected even during sheet conveyance. When a sheet extends over both of the two conveying means, the device taught in Patent 2,846,926 controls the two drive means to an equal speed.

The problem with the control over the individual conveying means is that a particular variable-speed drive source must be assigned to each drive means. This, coupled with the fact that both of the two drive sources must be variably controlled, complicates a control system and increases the cost.

Assume that only one of the control means respectively assigned to the upstream and downstream conveying means is controlled. Then, because a one-way clutch intervenes only between the upstream drive means and the upstream conveying means, the downstream conveying means accelerated pulls the upstream conveying means via a sheet being conveyed by the downstream conveying means. As a result, the upstream arrangement exerts a load on the conveyance and is likely to cause the sheet to crease or otherwise deform. This is undesirable from the reliable conveyance standpoint.

As for the sheet conveying device taught in the previously mentioned Laid-Open Publication No. 63-112626, assume that the intermediate conveying unit conveys a sheet toward the registration roller pair. Then, a difference in speed exists between the intermediate conveying unit and the body of the apparatus, i.e., between the conveying speed of the image forming section and that of the intermediate conveying unit. Consequently, a new sheet driven into the intermediate conveying unit is apt to crease or jam the path. Therefore, a new sheet cannot be introduced into the intermediate conveying unit during acceleration, so that productivity or printing efficiency is limited.

The problem with the sheet conveying device disclosed in the previously mentioned Patent No. 2,846,926 is that when a sheet extends both of the two conveying means, the drive means assigned to the two conveying means must be controlled at the same time. The device therefore needs a sophisticated control system. Moreover, the device must assign a particular variable-speed drive source to each drive means, resulting in an increase in cost.

In an image forming apparatus not including an intermediate tray, a sheet is sometimes brought to a stop on a path (path stacking) due to, e.g., an interrupt job or the delay of rearrangement of image data. Should the sheet be stopped at a position where the conveying speed is different, a load would act on the sheet at the time of restart and would thereby cause the sheet to crease.

Assume that the upstream and downstream conveying means each gripping a particular sheet are again driven to convey the sheets. Then, the distance between the sheets is the problem in the aspect of the size reduction of the image forming apparatus. If the upstream and downstream conveying means each are driven by particular drive means, then the drive timing of the upstream drive means may be controlled to adjust the distance between the sheets. However, in the case where the driving force of the downstream drive means is transmitted to the upstream conveying means, the above distance cannot be adjusted. It is therefore likely that the sheet positioned at the upstream side cannot be sensed. This obstructs accurate, reliable sheet conveyance.

Technologies relating to the present invention are also disclosed in, e.g., Japanese Patent Laid-Open Publication Nos. 8-217291 and 11-20993.

SUMMARY OF THE INVENTION

It is therefore an object of the present invention to provide a sheet conveying device, a drive control device, a duplex copy conveying unit, a sheet conveying method and a drive control method capable of smoothly transferring a sheet from upstream conveying means to downstream conveying means and smoothly conveying even a sheet, which extends over both of the upstream and downstream conveying means, as well as an image forming apparatus including the same.

It is another object of the present invention to provide a sheet conveying device, a drive control device, a duplex copy conveying unit, a sheet conveying method and a drive control method that are low cost and capable of preventing the productivity of copies (printing efficiency) from being lowered as well as an image forming apparatus including the same.

It is a further object of the present invention to provide a sheet conveying device, a duplex copy conveying unit and a sheet conveying device that are low cost and capable of easily adjusting a distance between consecutive sheets and thereby insuring reliable sheet conveyance as well as an image forming apparatus including the same.

In accordance with the present invention, a sheet conveying device includes an upstream and a downstream rotatable conveying mechanism respectively located on an upstream side and a downstream side on a preselected sheet conveyance path. A first and a second drive source respectively cause the upstream and downstream conveying mechanisms to rotate. The second drive source drives the downstream conveying mechanism at a variable conveying speed. A speed adjusting device causes the conveying speed of the upstream conveying mechanism to reflect the conveying speed of the downstream conveying mechanism that is variable.

Also, in accordance with the present invention, a drive control device controls a first and a second drive source for respectively causing an upstream and a downstream rotatable conveying mechanism, which are respectively located at an upstream side and a downstream side on a preselected sheet conveyance path, to rotate. The drive control device includes a speed adjusting device connecting the upstream and downstream conveying mechanisms for causing the conveying speed the upstream conveying mechanism, which is controlled by the second drive source, to reflect the conveying speed of the downstream conveying mechanism. A controller controls the second drive source such that when the conveying speed of the upstream conveying mechanism and that of the downstream conveying mechanism are to be varied, the downstream conveying mechanism rotates at a higher speed than the upstream conveying mechanism.

Further, in accordance with the present invention, a duplex copy conveying unit includes a reversing section for reversing a sheet, and a path for receiving the sheet conveyed from the reversing section. At least an upstream and a downstream rotatable conveying mechanism are respectively located at an upstream side and a downstream side on the path for conveying the sheet from the path to the outside of the path. A first and a second drive source respectively cause the upstream and downstream conveying mechanisms to rotate. The second drive source drives the downstream conveying mechanism at a variable conveying speed. A speed adjusting device causes the upstream conveying mechanism to reflect the conveying speed of the downstream conveying mechanism, which is variable.

Moreover, in accordance with the present invention, in an image forming apparatus for forming an image on a sheet that is conveyed by a sheet conveying device arranged in the apparatus, the sheet conveying device includes an upstream and a downstream rotatable conveying mechanism respectively located on an upstream side and a downstream side on a preselected sheet conveyance path. A first and a second drive source respectively cause the upstream and downstream conveying mechanisms to rotate. The second drive source drives the downstream conveying mechanism at a variable conveying speed. A speed adjusting device causes the conveying speed of the upstream conveying mechanism to reflect the conveying speed of the downstream conveying mechanism that is variable.

In addition, in accordance with the present invention, in a drive control method for controlling the conveying speed of an upstream rotatable conveying mechanism and the conveying speed of a downstream rotatable conveying mechanism, which are respectively located at an upstream side and a downstream side on a preselected sheet conveyance path, a first and a second drive source respectively cause the upstream and downstream conveying mechanisms to rotate. When a sheet extends over both of the upstream and downstream conveying mechanisms, the first drive source and upstream conveying mechanism are caused to slip on each other while the second drive source rotates the downstream conveying mechanism at a higher speed than the upstream conveying mechanism. The increased rotation speed of the downstream conveying mechanism is transmitted to the upstream conveying mechanism to thereby increase the conveying speed of the upstream conveying mechanism.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the present invention will be described hereinafter. Identical structural elements are designated by identical structural elements throughout the embodiments and will not be repeatedly described in order to avoid redundancy.

First Embodiment

Figure 1:
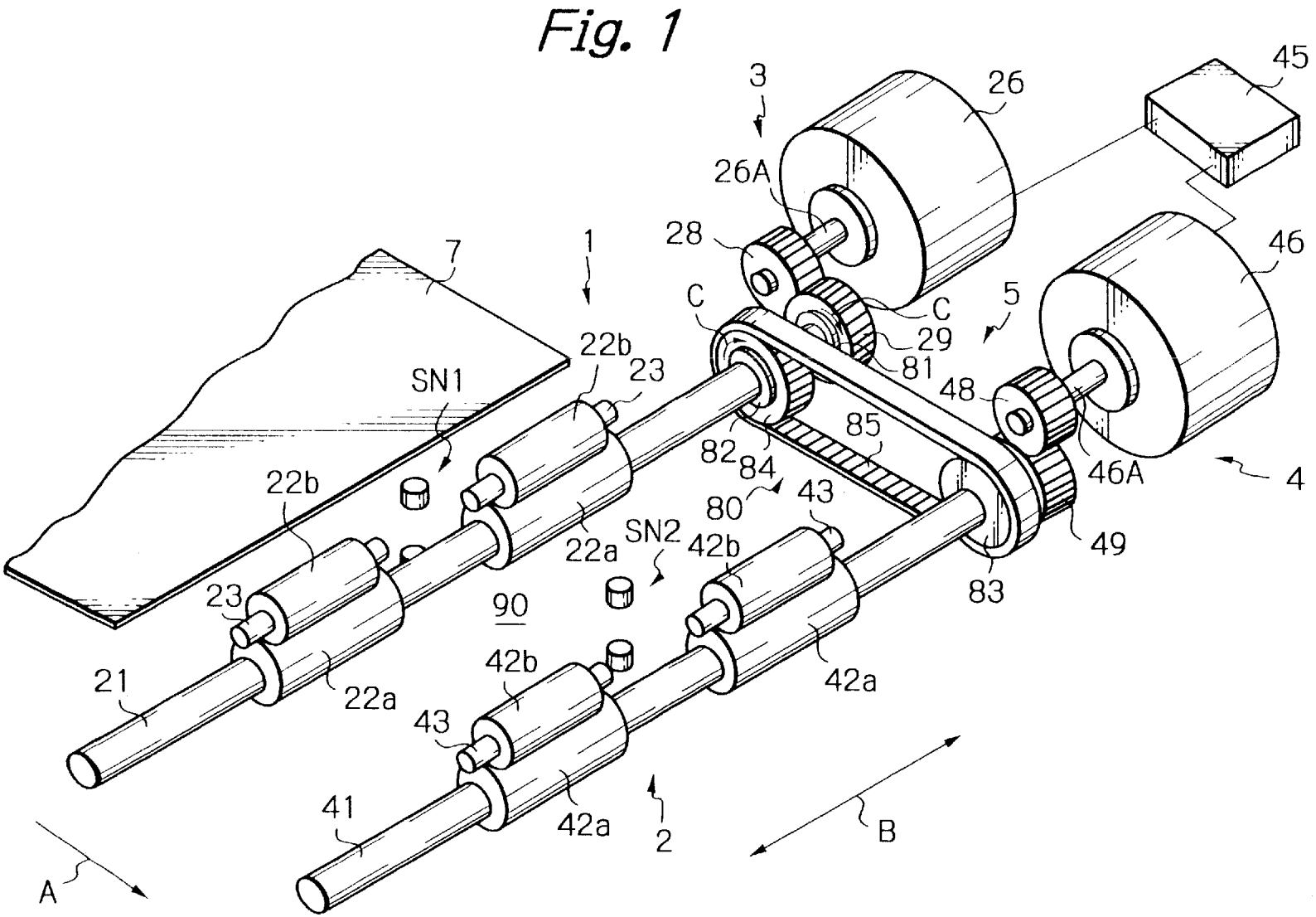
FIG. 1 is an isometric view showing the first embodiment of the sheet conveying device and drive control device in accordance with the present invention.

Referring to FIG. 1 of the drawings, a sheet conveying device and a drive control device embodying the present invention are shown and include two rotatable conveying means 1 and 2. A sheet 7 is conveyed along a path 90 in a direction indicated by an arrow A. The conveying means 1 and 2 are positioned on the path at the upstream side and downstream side, respectively, in the direction of sheet conveyance A. First and second drive means 3 and 4 respectively cause the conveying means 1 and 2 to rotate. A speed control means 5 causes the conveying speed of the conveying means 1 to reflect the conveying speed of the conveying means 2.

The conveying means 1 is implemented by drive rollers 22*a* and driven rollers 22*b* provided in pairs. The drive rollers 22*a* are affixed to a drive shaft 21 extending in a widthwise direction B of the sheet 7, which is substantially perpendicular to the direction of sheet conveyance A. The driven rollers 22*b* are rotatably mounted on a support shaft 23, which is substantially parallel to the drive shaft 21. The drive shaft 21 is journalled to a frame, not shown, via bearings, not shown, while the support shaft 23 is affixed to the frame. In the illustrative embodiment, two drive rollers 22*a* and two driven rollers 22*b* are arranged in the axial direction and face the path 90. The driven rollers 22*b* are pressed against the drive rollers 22*a*.

Likewise, the conveying means 2 is implemented by drive rollers 42*a* and driven rollers 42*b* provided in pairs. The drive rollers 42*a* are affixed to a drive shaft 41 extending in a widthwise direction B of the sheet 7. The driven rollers 42*b* are rotatably mounted on a support shaft 43, which is substantially parallel to the drive shaft 41. The drive shaft 41 is journalled to the frame via bearings, not shown, while the support shaft 43 is affixed to the frame. In the illustrative embodiment, two drive rollers 42*a* and two driven rollers 42*b* are arranged in the axial direction and face the path 90. The driven rollers 42*b* are pressed against the drive roller 42*a*.

If desired, the drive rollers 22*a* and 42*a* may be pressed against the driven rollers 22*b* and 42*b*, respectively. The support shafts 23 and 43 may be press-fitted in the driven rollers 22*b* and 42*b*, respectively, and journalled to the frame via bearings. The number of drive rollers and that of driven rollers each may be one or three or more, if desired.

The drive means 3 includes an electric motor or drive source 26 having an output shaft 26A, an output gear 28 mounted on the output shaft 26A, and a gear 29 meshing with the output gear 28. Likewise, the drive means 4 includes an electric motor or drive source 46 having an output shaft 46A, an output gear 48 mounted on the output shaft 46A, and a gear 49 mounted on one end of the drive shaft 41 and meshing with the output gear 48. The motor 26 rotates at a constant speed while the motor 46 rotates at a variable speed. Basically, therefore, the motor 26 rotates the drive rollers 22*a* and driven rollers 22*b* at a constant speed while the motor 46 rotates the drive rollers 42*a* and driven rollers 42*b* at a variable speed.

The speed control means S includes power transmitting means 80 connecting the conveying means 1 and 2, and a first and a second one-way clutch 81 and 82. The power transmitting means 80 is made up of a toothed pulley affixed to the drive shaft 41, a toothed pulley 84 mounted on the drive shaft 21 via the one-way clutch 82, and an endless timing belt 85 passed over the pulleys 83 and 84.

The one-way clutch 81 is positioned between the upstream conveying means 1 and the first drive means 3, i.e., the drive shaft 21 and the gear 29, connecting the conveying means 1 and drive means 3. The one-way clutch 81 transmits only the rotation of the motor 26 that conveys the paper sheet 7 in the direction A to the conveying means 1. The one-way clutch 82 is positioned between the drive shaft 21 and the power transmitting means 80, i.e., the toothed pulley 84, connecting the conveying means 1 and 2. The one-way clutch 82 transmits only the rotation of the motor 46 that conveys the sheet 7 in the direction A at an increased speed to the conveying means 1. The one-way clutches 81 and 82 are mounted on the drive shaft 21 of the conveying means 1 such that they lock in the same direction C shown in FIG. 1. The clutches 81 and 82 coaxially mounted on the same shaft of the conveying means 1 occupies a minimum of space.

The motors 26 and 46 are electrically connected to control means 45 included in a drive control device and constituted mainly by a microcomputer. The control means 45 controls the conveying speed of the conveying means 1 and 2 by controlling the rotation speeds of the motors 26 and 46. Specifically, to increase the conveying speed of the conveying means 1 and 2, the control means 45 increases only the rotation speed of the motor 46 such that the conveying means 2 rotates at a higher speed than the conveying speed 1.

The drive control device additionally includes first and second sheet sensing means SN1 and SN2 for determining the sheet conveying conditions of the conveying means 1 and 2. The sheet sensing means SN1 and SN2 are electrically connected to the control means 45, and each is implemented by a transmission type photosensor. The sheet sensing means SN1 faces the path 90 at a position upstream of the conveying means 1 in the direction A. The sheet sensing means SN2 faces the path 90 between the conveying means 1 and 2. After the control means 45 has accelerated the rotation of the motor 46, it stops the rotation of the motor 46 in response to the output of the sheet sensing means SN1. The control means 45 then stops the rotation of the motor 26 in response to the output of the sheet sensing means SN2.

The acceleration and stop of rotation will be described more specifically with reference to FIGS. 2A through 2D. It is to be noted that FIGS. 2A through 2D schematically show the arrangements of FIG. 1, neglecting some positional differences. As shown, conveying means 64 is positioned upstream of the conveying means 1 and implemented by a pair of rollers. The conveying means 64 is included in an apparatus on which the sheet conveying device and drive control device are mounted. A motor 47 also mounted on the apparatus drives the conveying means 64 at a speed up equal to the conveying speed of the conveying means 1.

Figure 2A:
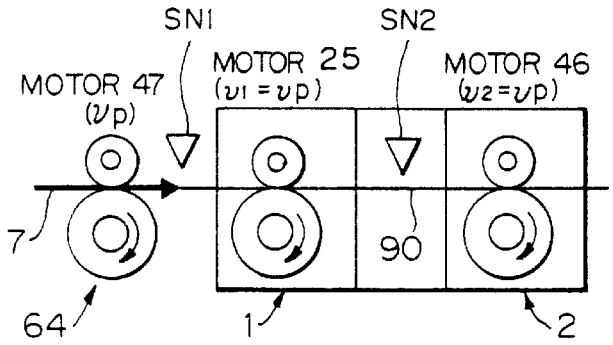
FIGS. 2A through 2D demonstrate the operation of the first embodiment.
Figure 2B:
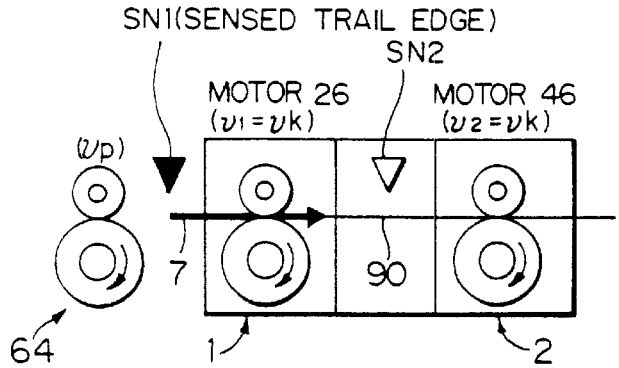

As shown in FIG. 2A, the motors 47, 26 and 46 are driven such that the conveying means 61, 1 and 2, respectively, rotate at the same speed u1=up. In this condition, the sheet 7 being conveyed by the conveying means 64 is introduced into the sheet conveying device by the conveying means 1. As shown in FIG. 2B, when the trailing edge of the sheet 7 moves away from the sheet sensing means SN1, the motor 46 accelerates the conveying means 2 to a conveying speed u2=uK.

The acceleration of the rotation of the conveying means 2 is transferred to the drive shaft 21 via the timing belt 85, toothed pulley 84 and one-way clutch 82. As a result, the conveying means 1 is also accelerated to a conveying speed u1=uK. More specifically, all the conveying means 64, 1 and 2 shown in FIG. 2B are rotated at the higher speed u1=u2=uK. Although the drive shaft 21, FIG. 1, rotates, the one-way clutch 81 causes the gear 29 to slip on the drive shaft 21 and thereby prevents the rotation of the gear 29 from being transferred to the drive shaft 21.

Whether the sheet 7 extends over both of the conveying means 1 and 2 or not, the conveying speeds of the conveying means 1 and 2 can be increased only if the speed of the motor 46 is controlled. This can be done without causing the sheet 7 to be pulled between the conveying means 1 and 2 and therefore insures crease-free, reliable conveyance. Because the motor 26 does not have to be controlled, the control system is simple. Further, a variable-speed motor, which would increase the cost, does not have to be applied to the motor 26.

Figure 2C:
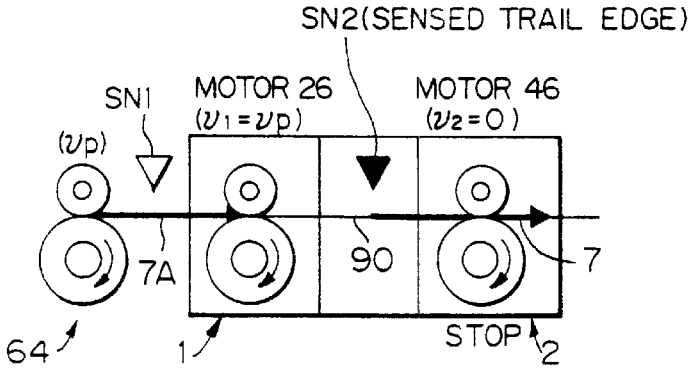

As shown in FIG. 2C, when the sheet sensing means SN2 senses the trailing edge of the sheet 7, the control means 45, FIG. 1, stops driving the motor 46, determining that the sheet 7 does not extend over both of the conveying means 1 and 2. This is effected to, e.g., adjust the timing for conveying the sheet 7 to the next stage or to guarantee a waiting time necessary for the adjustment of the delay of image rearrangement.

As soon as the motor 46 stops rotating, the conveying means 2 stops driving the conveying means 1. At this instant, the motor 26 is still rotating. Also, the toothed pulley 84 is mounted on the drive shaft 21 via the one-way clutch 82. Consequently, as shown in FIG. 2C, the conveying means 1 restores the previous conveying speed u1=up. Therefore, even when another sheet 7A follows the sheet 7, the sheet 7A can be smoothly transferred from the conveying means 64 to the conveying means 1.

Figure 2D:
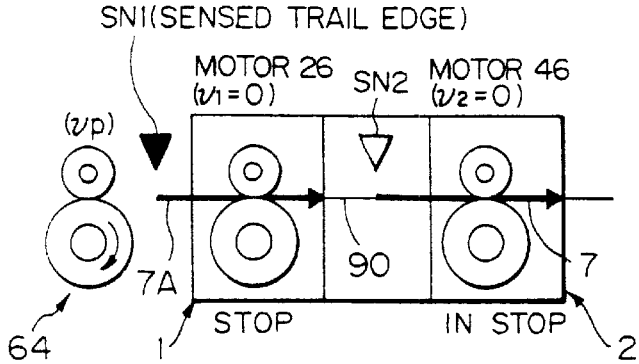

As shown in FIG. 2D, when the sheet sensing means SN1 senses the trailing edge of the following sheet 7A, the control means 45 stops driving the motor 26. As a result, a plurality of sheets 7 and 7A are brought to a stop on the path 90 (path stacking).

As stated above, in the illustrative embodiment, the drive means 3 and 4 respectively drive the conveying means 1 and 2 respectively positioned at the upstream side and downstream side of the path 90, thereby conveying the sheet 7. When the sheet 7 extends over both of the conveying means 1 and 2, the drive means 3 and conveying means 1 simply slip on each other. At the same time, the motor 46 causes the conveying means 2 to rotate at a higher speed than the conveying means 1. The rotation speed of the conveying means 2 is transferred to the conveying means 1. Consequently, the conveying means 1 and 2 convey the sheet 7 at the same increased speed.

The positions of the sheet sensing means SN1 and SN2 shown and described are only illustrative. Also, the sheet sensing means SN1 and SN2 each may be responsive to the leading edge of the sheet 7, if desired.

Second Embodiment

Figure 3:
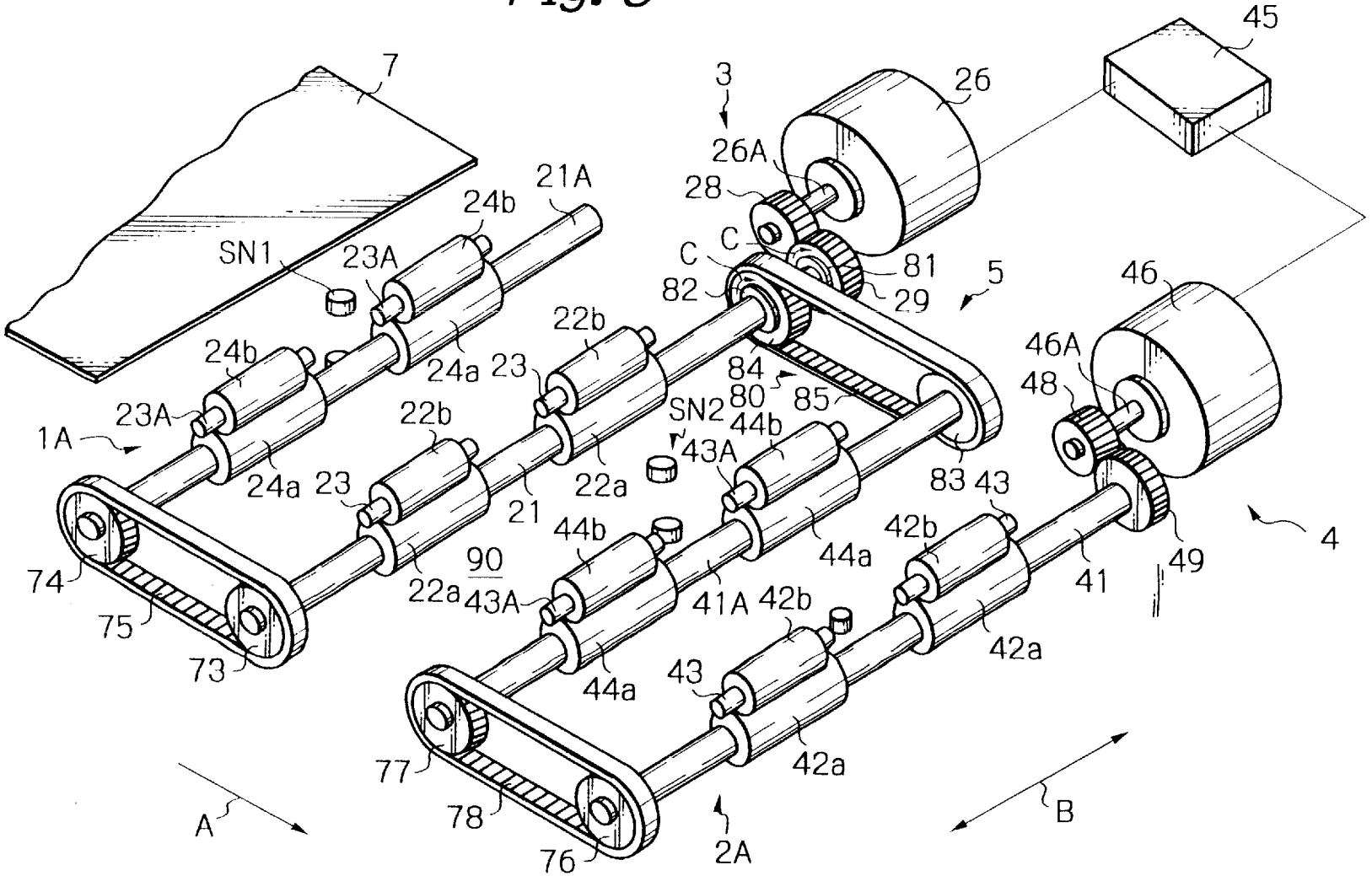
FIG. 3 is an isometric view showing a second embodiment of the present invention.

FIG. 3 shows an alternative embodiment of the present invent on. As shown, conveying means 1A includes two sets of drive rollers 22*a* and 24*a* and two sets of driven rollers 22*b* and 24*b*. Likewise, conveying means 2A includes two sets of drive rollers 42*a* and 44*a* and two sets of driven rollers 42*b* and 44*b*.

The conveying means 1A includes a drive shaft 21A and a support shaft 23A parallel to the drive shaft and positioned upstream of the drive shaft 21. The drive rollers 24*a* are affixed to the drive shaft 21A while the driven rollers 24*b* are rotatably mounted on the support shaft 23A. The drive rollers 24*a* and driven rollers 24*b* are pressed against each other. Toothed pulleys 73 and 74 are affixed to the ends of the drive shafts 21 and 21A, respectively. An endless timing belt 75 is passed over the toothed pulleys 73 and 74, connecting the drive shafts 21 and 21A.

The conveying means 2A includes a drive shaft 41A and a support shaft 43A positioned upstream of the drive shaft 41 and parallel to the drive shaft 41. Drive rollers 44*a* are affixed to the drive shaft 41A while the driven rollers 44*b* are rotatably mounted on the support shaft 43A. The drive rollers 44*a* and driven rollers 44*b* are pressed against each other. Toothed pulleys 76 and 77 are affixed to the ends of the drive shafts 41 and 41A, respectively. An endless timing belt 78 is passed over the toothed pulleys 76 and 77, connecting the drive shafts 41 and 41A. The pitch between the drive shafts 21 and 21A and the pitch between the drive shafts 41 and 41A each are selected such that the cooperative rollers mounted thereon can nip the sheet 7 of the minimum size being conveyed along the path 90.

In the illustrative embodiment, the toothed pulley 83 mounted on the end of the drive shaft 1 in the first embodiment is mounted on the end of the drive shaft 41A. The timing belt 85 is passed over the toothed pulley 83 and the toothed pulley 84, which is mounted on the drive shaft 21 via the one-way clutch 82. In the illustrative embodiment, the sheet sensing means SN1 faces the path 90 at a position upstream of the drive shaft 21A in the direction A. The sheet sensing means SN2 faces the path 90 between the drive shafts 21 and 41A.

Reference will be made to FIGS. 4A through 4D for describing the acceleration and stop of rotation of the illustrative embodiment. Again, FIGS. 4A through 4D schematically show the arrangements of FIG. 3, neglecting some positional differences. As shown, the conveying means 64 is positioned upstream of the conveying means 1A. The motor 47 drives the conveying means 64 at a speed up equal to the conveying speed of the conveying means 1A.

Figure 4A:
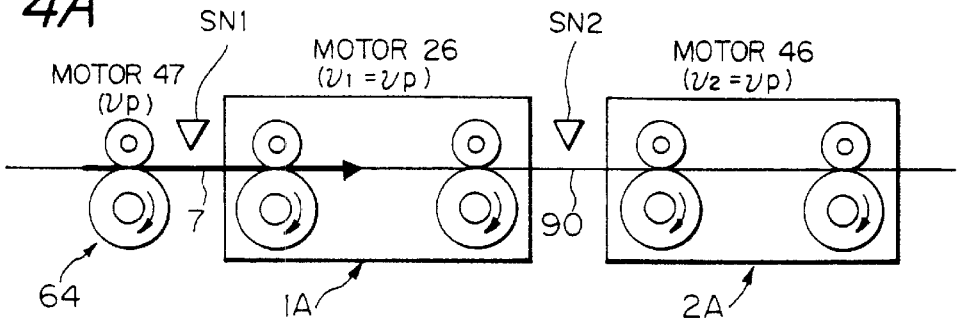
FIGS. 4A through 4D demonstrate the operation of the second embodiment.
Figure 4B:
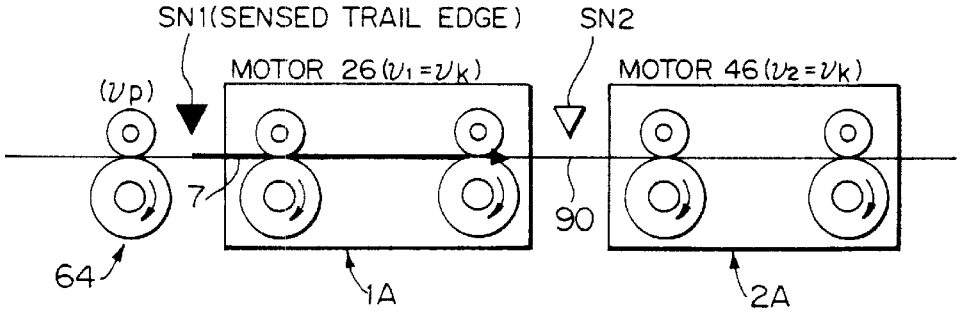

As shown in FIG. 4A, the motors 47, 26 and 46 are driven such that the conveying means 61, 1 and 2, respectively, rotate at the same speed u1=up. In this condition, the sheet 7 being conveyed by the conveying means 64 is introduced into the sheet conveying device by the conveying means 1A. That is, all the conveying means 64, 1A and 2B shown in FIG. 4B are driven at the same speed u1=u2=uK. Assume that the drive shaft 21 is accelerated. Then, although the drive shaft 26 rotates, the one-way clutch 81 causes the gear 29 to slip on the drive shaft 21 and thereby prevents the rotation of the gear 29 from being transferred to the drive shaft 21.

Whether the sheet 7 extends over both of the conveying means 1A and 2A or not, the conveying speeds of the conveying means 1A and 2A can be increased only if the speed of the motor 46 is controlled. This can be done without causing the sheet 7 to be pulled between the conveying means 1A and 2A and therefore insures crease-free, reliable conveyance. Because the motor 26 does not have to be controlled, the control system is simple Further, a variable-speed motor, which would increase the cost, does not have to be applied to the motor 26.

Figure 4C:
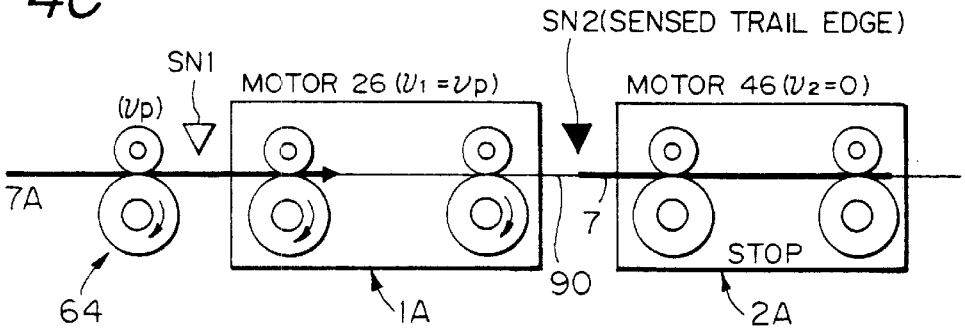

As shown in FIG. 4C, when the sheet sensing means SN2 senses the trailing edge of the sheet 7, the control means 45, FIG. 3, stops driving the motor 46, determining that the sheet 7 does not extend over both of the conveying means 1A and 2A. As soon as the motor 46 stops rotating, the conveying means 2A stops driving the conveying means 1A. At this instant, the motor 26 is still rotating. Also, the toothed pulley 84 is mounted on the drive shaft 21 via the one-way clutch 82. Consequently, as shown in FIG. 4C, the conveying means 1A restores the previous conveying speed u1=up. Therefore, even when another sheet 7A follows the sheet 7, the sheet 7A can be smoothly transferred from the conveying means 64 to the conveying means 1A.

Figure 4D:
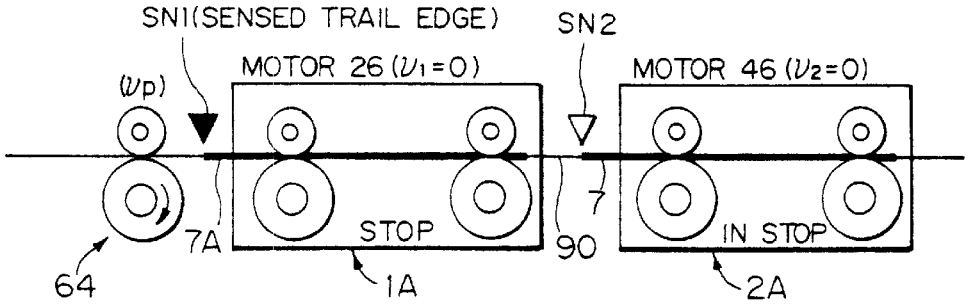

As shown in FIG. 4D, when the sheet sensing means SN1 senses the trailing edge of the following sheet 7A, the control means 45 stops driving the motor 26. As a result, a plurality of sheets 7 and 7A are brought to a stop on the path 90.

As stated above, in the illustrative embodiment, too, when the sheet 7 extends over both of the conveying means 1A and 2A, the drive means 3 and conveying means 1A simply slip on each other. At the same time, the motor 46 causes the conveying means 2A to rotate at a higher speed than the conveying means 1A. The rotation speed of the conveying means 2A is transferred to the conveying means 1A. Consequently, the conveying means 1A and 2A convey the sheet 7 at the same increased speed.

Third Embodiment

Figure 5:
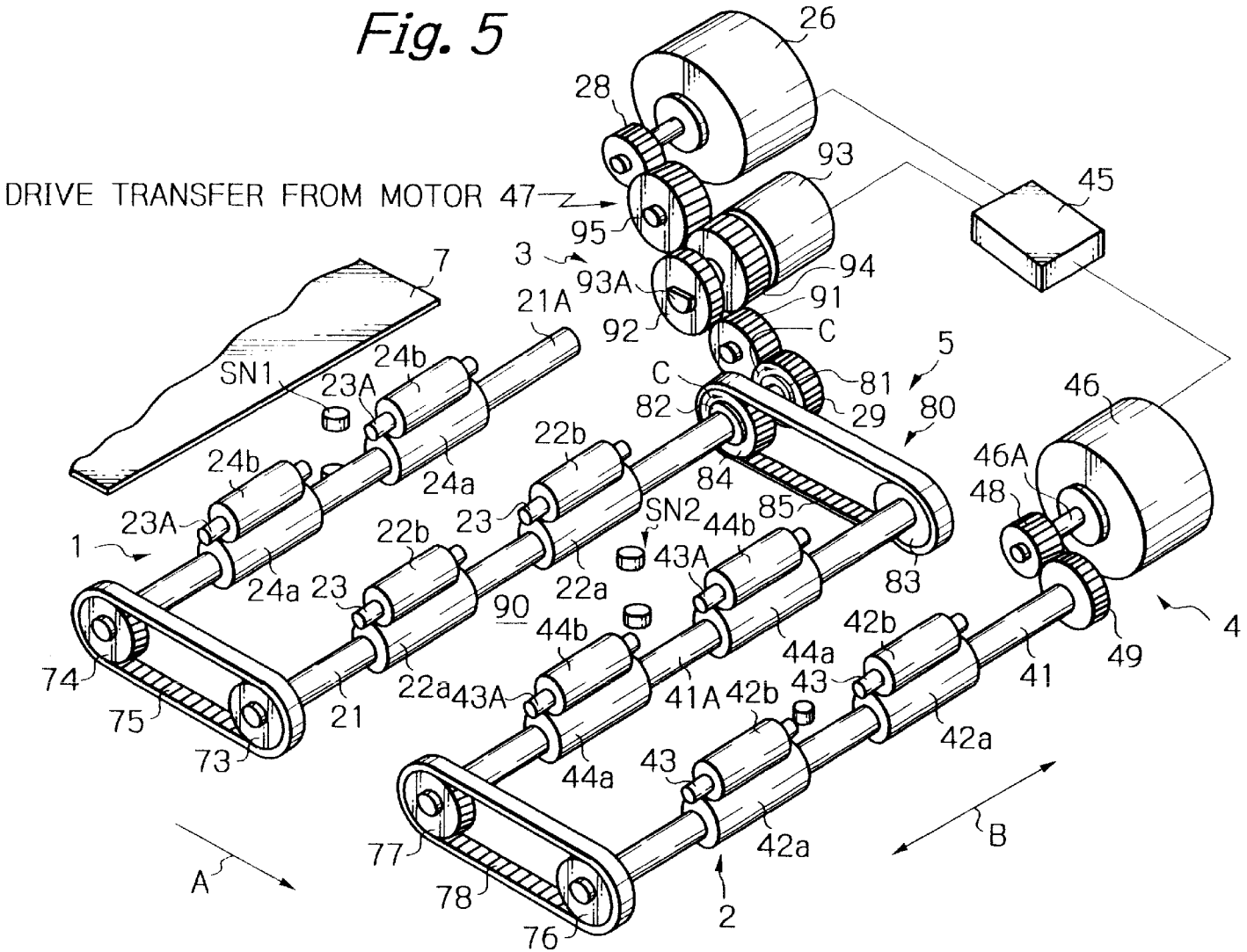
FIG. 5 is an isometric view showing a third embodiment of the present invention.

FIG. 5 shows another alternative embodiment of the present invention. As shown, a clutch or coupling/uncoupling means 93 is positioned between the drive motor 26 of the drive means 3 assigned to the conveying means 1 or 1A and the one-way clutch 81. The clutch 93 selectively transfers the rotation of the motor 26 to the conveying means 1 or 1A or interrupts it. As for the general construction, the illustrative embodiment is similar to the second embodiment.

The clutch 93 is implemented by a solenoid-operated clutch and electrically connected to the control means 45. Specifically, the clutch 93 includes a shaft 93A on which gears 92 and 94 are mounted. The gear 92 is connected to the gear 29 via a gear 91 while the gear 94 is connected to the gear 28 of the motor 26 via a gear 95. When the control means 45 couples the clutch 93, the clutch 93 causes the gear 94 to rotate integrally with the shaft 93A. When the control means 45 uncouples the clutch 93, the clutch 93 allows the gear 94 to freely rotate relative to the shaft 93A.

As stated above, the clutch 93 intervening between the motor 26 and the one-way clutch 81 is selectively coupled or uncoupled in order to control drive transmission from the motor 26 to the conveying means 1A or 1. This makes it needless to ON/OFF control the motor 26. This allows the following sheet 7A to be stopped in the same manner as described with reference to FIG. 2D or 4D. The function of the motor 26 for controlling drive transmission to the conveying means 1A or 1 via the clutch 93 may be also be assigned to the motor 47 shown in FIG. 2 or 4.

Fourth Embodiment

Figure 6:
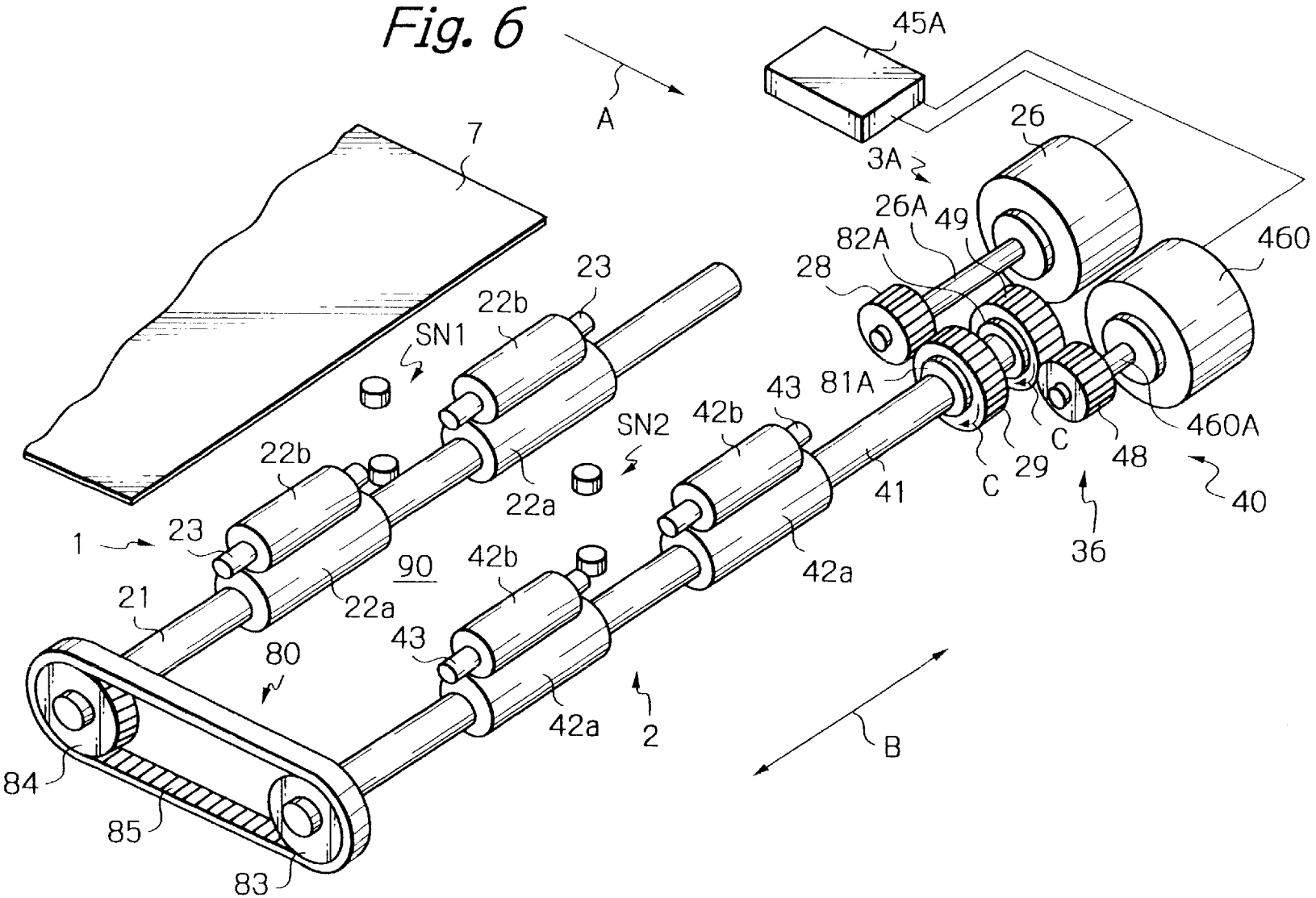
FIG. 6 is an isometric view showing a fourth embodiment of the present invention.

FIG. 6 shows another alternative embodiment of the present invention. As shown, the sheet conveying device includes the conveying means 1 and 2 respectively positioned at the upstream side and downstream side in the direction of sheet conveyance A. Drive means 3A causes the conveying means 2 to rotate. Drive means 40 accelerates the rotation of the conveying means 2. Power transmitting means 80 connects the conveying means 1 and 2. The sheet conveying device additionally includes one-way clutches 81A and 82A.

A gear 29, which is a specific form of the drive means 3A, is mounted on a drive shaft 41 via the one-way clutch 81A. The drive means 3A and conveying means 2 are connected to each other via the one-way clutch 81A. The one-way clutch 81A is positioned between the motor 26 and the conveying means 2 so as to transfer the rotation of the motor 26 that conveys the sheet 7 in the direction A to the conveying means 2.

The acceleration drive means 40 includes a variable-speed motor or drive source 460, an output gear 48 mounted on the output shaft 460A of the motor 460, and a gear 49 mounted on the drive shaft 41 via the one-way clutch 82A and held in mesh with the output gear 48. The one-way clutch 82A is positioned between the drive means 40 and the conveying means 2 so as to transfer the rotation of the motor 460 that conveys the sheet 7 in the direction A to the conveying means 2. The one-way clutches 81A and 82 are coaxially mounted on the drive shaft 41 of the conveying means 2 such that they lock in the same direction C shown in FIG. 6.

The motors 26 and 460 are electrically connected to control means 45A included in a drive control device. Major part of the control means 45A is implemented by a microcomputer and controls the conveying speeds of the conveying means 1 and 2 via the motors 26 and 460. Specifically, to accelerate the rotation of the conveying means 1 and 2, the control means 45A accelerates only the rotation of the motor 460.

The sheet sensing means SN1 faces the path 90 at a position upstream of the drive shaft 21 while the sheet sensing means SN2 faces the path 90 between the drive shafts 21 and 41. The sheet sensing means SN1 and SN2 are electrically connected to the control means 45A.

To cause the conveying means 1 and 2 to rotate at the preselected speed up, the control means 45A drives the motor 26. To accelerate the rotation of the conveying means 1 and 2, the control means 45A drives the motor 460 at a higher speed than the motor 26. The control means 45A drives the motor 26 when the sheet sensing means SN1 senses the leading edge of the sheet 7 or drives the motor 460 while driving the motor 26 when the sheet sensing means SN2 senses the leading edge of the sheet 7.

In operation, when the sheet sensing means SN1 shown in FIG. 6 senses the leading edge of the sheet 7, the control means 45A drives the motor 26. The rotation of the output shaft 26A of the motor 226 is transmitted to the drive shaft 41 via the output shaft 28, gear 29 and one-way clutch 81A, rotating the drive shaft 41 in the locking direction C. At the same time, the rotation of the output shaft 26A is transferred to the drive shaft 21 via the power transmitting means 80. As a result, the drive shafts 21 and 41 rotate at the same speed in the same direction, so that the sheet 7 is conveyed in the direction A by being nipped between the drive rollers 22*a* and driven rollers 22*b*.

When the sheet sensing means SN2 senses the leading edge of the sheet 7, the control means 45A drives the motor 460. The rotation of the output shaft 460A of the motor 460 is transmitted to the drive shaft 41 via the output gear 48, gear 49 and one-way clutch 82A, accelerating the rotation of the drive shaft 41. At the same time, the rotation of the output shaft 460A is transferred to the drive shaft 21 via the power transmitting means 80. When the rotation of the drive shaft 41 is accelerated, the one-way clutch 81A causes the gear 29 to slip on the drive shaft 41, preventing the rotation of the motor 26 from being transferred to the drive shaft 21. The drive shafts 21 and 41 are therefore accelerated in the same direction. Consequently, the sheet 7 is conveyed at the increased speed in the direction A by being nipped between the drive rollers 22*a* and the driven rollers 22*b* and between the drive rollers 42*a* and the driven rollers 42*b*.

In the illustrative embodiment, whether the sheet 7 extend over both of the conveying means 1 and 2 or not, the conveying speeds of the conveying means 1 and 2 can be increased only if the speed of the motor 460 is controlled. This can be done without causing the sheet 7 to be pulled between the conveying means 1 and 2 and therefore insures crease-free, reliable conveyance. Because the motor 26 does not have to be controlled, the control system is simple. Further, a variable-speedmotor, which would increase the cost, does not have to be applied to the motor 26. In addition, the motors 26 and 640 coaxially mounted on the drive shaft 41 occupy a minimum of space, implementing a small-size apparatus.

Fifth Embodiment

Figure 7:
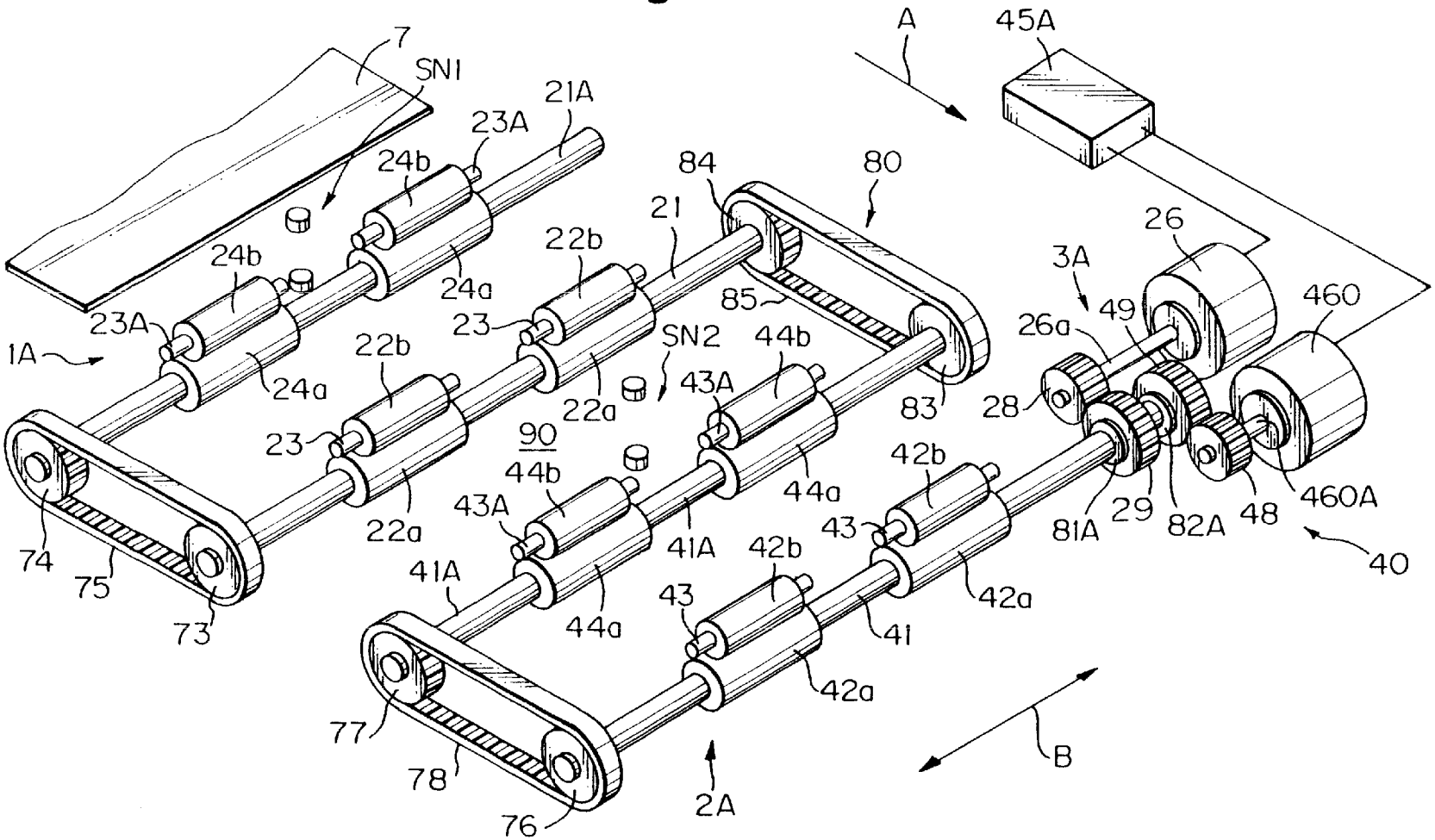
FIG. 7 is an isometric view showing a fifth embodiment of the present invention.

FIG. 7 shows a fifth embodiment of the present invention. As shown, This embodiment combines the conveying means 1A and 2A of the second embodiment and the drive means 3A and 40 of the fourth embodiment. In operation, when the control means 45A accelerates the motor 460, the one-way clutch 81A prevents the rotation of the motor 26 from being transferred to the drive shaft 41. Therefore, only the rotation of the motor 460 is transferred to the drive shaft 21A via the drive shaft 41, timing belt 78, drive shaft 41A, power transmitting means 80, drive shaft 21, and timing belt 75. In this manner, a single motor 460 can increase the rotation speed of the four sets of rollers alone.

The sheet 7 of any one of the first to fifth embodiments may be a paper sheet or an OHP (OverHead Projector) sheet for use with an image forming apparatus, a postcard, a name card, an envelope, a note, a magnetic card, an IC (Integrated Circuit) card or the like. The first to fifth embodiments each are applicable to any kind of conveying system in which conveying means spaced from each other in the direction of conveyance A each convey a sheet at a particular speed.

Sixth Embodiment

Figure 8:
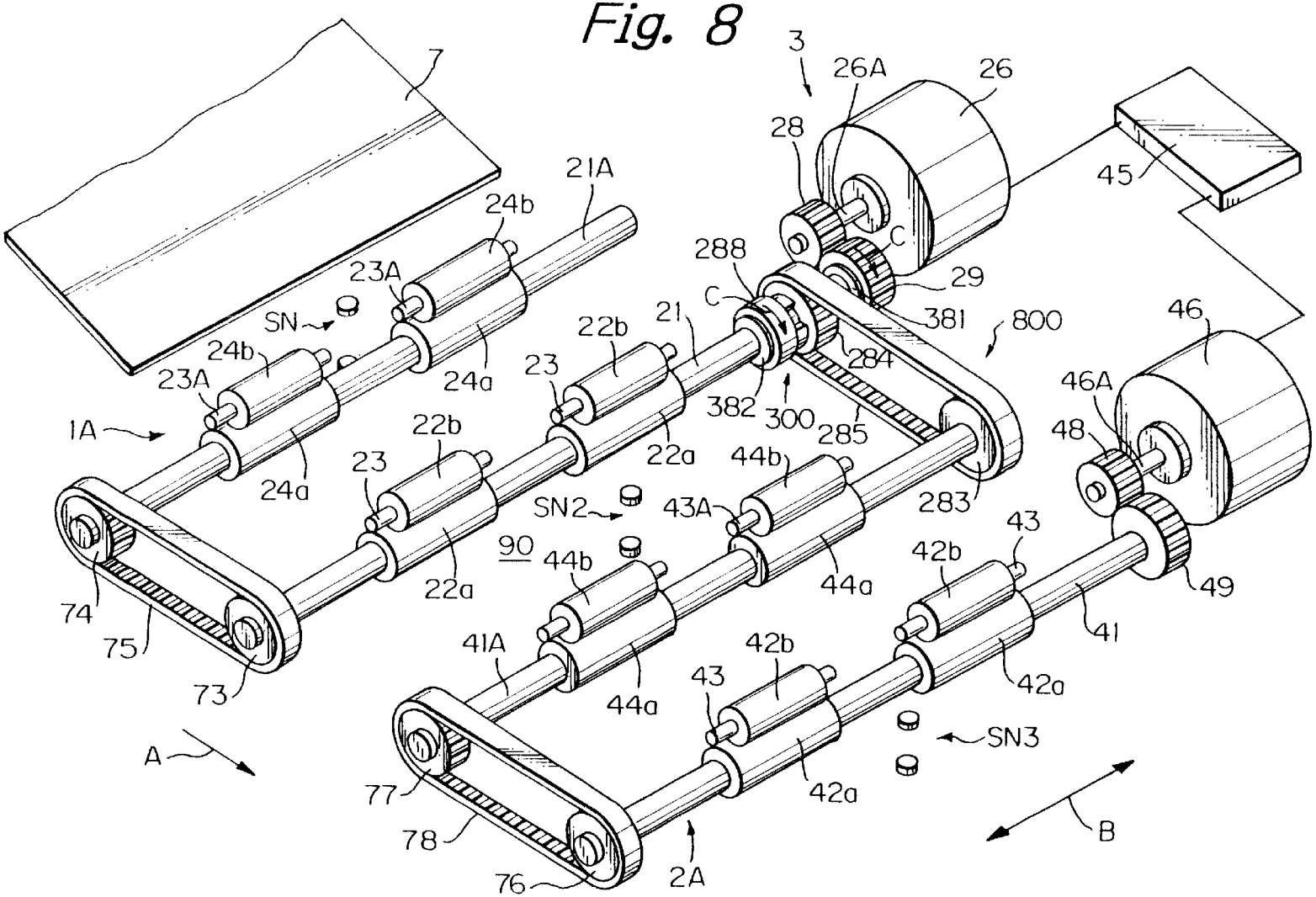
FIG. 8 is an isometric view showing a sixth embodiment of the present invention.

FIG. 8 shows another alternative embodiment of the present invention including the rotatable conveying means 1A and 2A respectively located at the upstream side and downstream side in the direction A. The drive means 26 and 46 drive the conveying means 1A and 2A, respectively. The sheet conveying device includes power transmitting means 800 connecting the conveying means 1A and 2A, a first and a second one-way clutch 381 and 382, and delaying means 300 for delaying the transfer of the rotation of the motor 46 to the conveying means 1A. The conveying means 1A and 2A and motors 26 and 46 are constructed and arranged in the same manner as in the second embodiment. The following description will concentrate on the power transmitting means 800, delaying means 300 and one-way clutches 381 and 382 unique to the illustrative embodiment.

The power transmitting means 800 includes a toothed pulley 283 affixed to the drive shaft 41 of the conveying means 2A and a toothed pulley 284 rotatably mounted on the drive shaft 21 of the conveying means 1A. An endless timing belt 285 is passed over the toothed pulleys 283 and 284. The one-way clutch 381 is positioned between the conveying means 1A and the motor 26, i.e., the drive shaft 21 and the gear 29, connecting the conveying means 1A and drive means 3. The clutch 381 transfers only the rotation of the motor 26 that conveys the sheet 7 in the direction A to the conveying means 1A.

The delaying means 300 is made up of a toothed pulley of first engaging member 284 and a drive transmitting member or second engaging member 288. The toothed pulley 284 is rotatable integrally with the power transmitting means 800. The drive transmitting member 288 is engageable with the toothed pulley 284 and rotatable integrally with the one-way clutch 382.

The drive transmitting member 288 is mounted on the circumference of the one-way clutch 382, which is affixed to the drive shaft 21. When the drive transmitting member 288 engages with the toothed pulley 284 and rotates integrally with the latter, the rotation of the conveying means 2A is transferred to the conveying means 1A. The one-way clutch 382 is positioned between the drive shaft 21 and the drive transmitting member 288, connecting the conveying means 1A and 2A. The clutch 382 transfers the rotation of the motor 46 that conveys the sheet 7 in the direction A to the conveying means 1A. The clutches 381 and 382 are coaxially mounted on the drive shaft 21 such that they lock in the same direction C shown in FIG. 8. The clutches 381 and 382 therefore occupy a minimum of space.

Figure 9A:
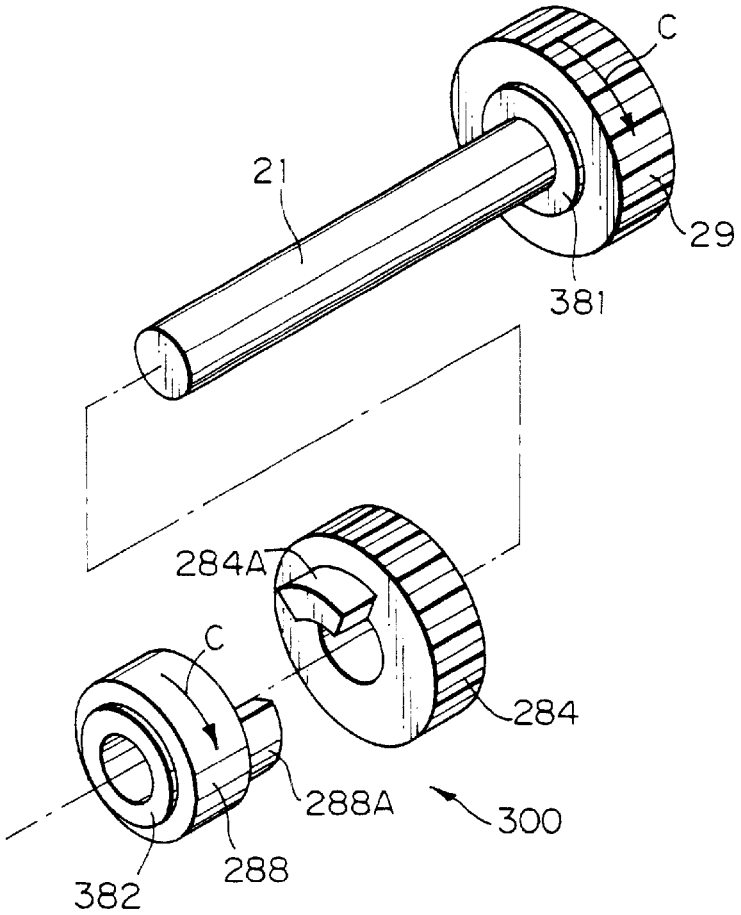
FIG. 9A is an exploded isometric view showing delaying means included in the sixth embodiment.
Figure 9B:
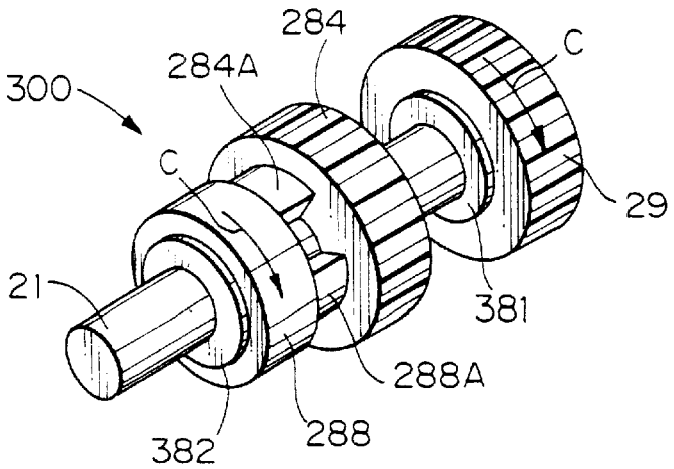
FIG. 9B shows the delaying means in an assembled condition.

As shown in FIGS. 9A and 9B, the toothed pulley 284 and drive transmitting member 288 face each other on the drive shaft 21. Arcuate projections 284A and 288A respectively protrude from the facing surfaces of the pulley 284 and drive transmitting member 288 toward each other, and each has a center coinciding with the axis of the drive shaft 21. The projections 284A and 288A each extend over an anglar range delimited by imaginary lines that connect the axis of the drive shaft 21 and opposite ends of the projection. As shown in FIGS. 12A through 12G, the sum θ1 of the angles of the two projections 284A and 288A is selected to be smaller than 360°. Therefore, when the increased rotation speed is transferred from the conveying means 2A to the toothed pulley 284 to cause the pulley 284 to rotate, the pulley 284 performs idle rotation over an angle $\theta=360°-\theta 1$.

As shown in FIG. 8, the sheet sensing means SN1 faces the path 90 at a position upstream of the conveying means 1A while the sheet means SN2 faces the path 90 between the conveying means 1A and 2A. In addition, sheet sensing means SN3 faces the path 90 at a position downstream of the conveying means 2A. The control means 45 controls the motors 26 and 46 in accordance with the outputs of the sheet sensing means SN1 through SN3, as will be described specifically later.

Reference will be made to FIGS. 10A through 10D for describing the acceleration and stop unique to the illustrative embodiment. FIGS. 10A through 10D schematically show the arrangements of FIG. 8, neglecting some positional differences. As shown, the conveying means 64 is positioned upstream of the conveying means 1A. The motor 47 drives the conveying means 64 at a speed up equal to the conveying speed of the conveying means 1A.

Figure 10A:
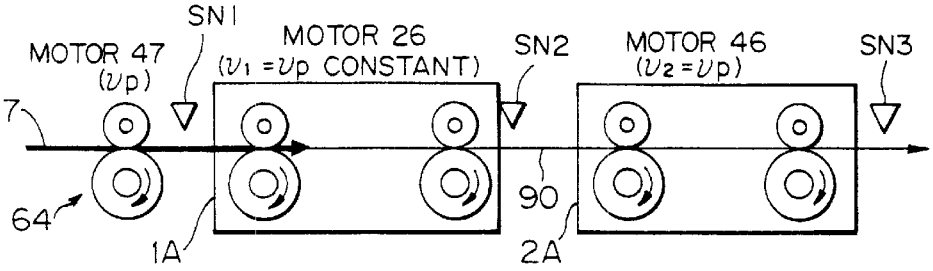
FIGS. 10A through 10D demonstrates a specific operation of the sixth embodiment.
Figure 10B:
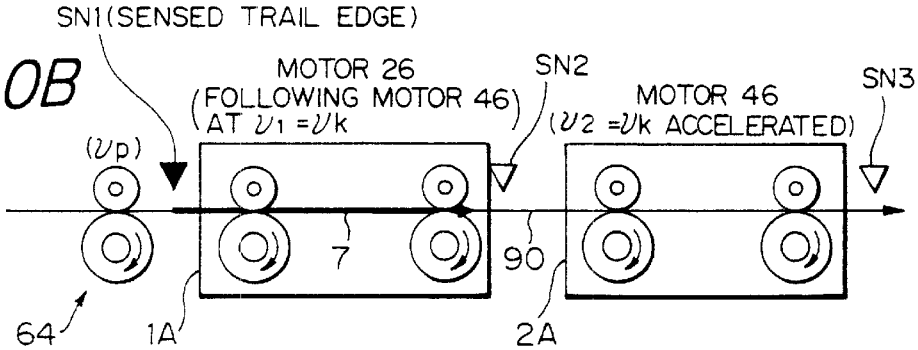

As shown in FIG. 10A, the motors 47, 26 and 46 are driven such that the conveying means 64, 1 and 2, respectively, rotate at the same speed u1=up. In this condition, the sheet 7 being conveyed by the conveying means 64 is introduced into the sheet conveying device by the conveying means 1A. As shown in FIG. 10B, when the sheet sensing means SN1 senses the trailing edge of the sheet 7, the controller 45 accelerates the conveying speed of the conveying means 2A to u2=uK via the motor 46.

Figure 12A:
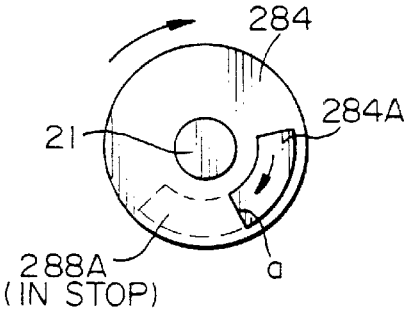
FIGS. 12A through 12G demonstrate a delaying function unique to the sixth embodiment.
Figure 12B:
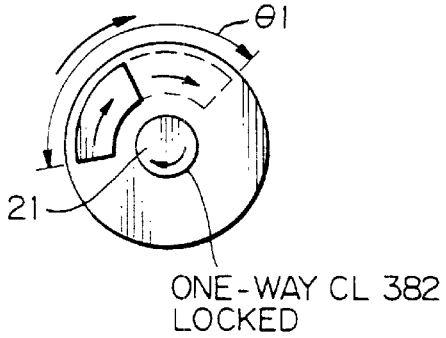

The acceleration of the conveying means 2A is transferred to the drive shaft 41A via the timing belt 78 and toothed pulley 77. Further, the rotation of the drive shaft 41A is transferred to the drive shaft 21 via the power transmitting means 800, delaying means 300, one-way clutch 382. As a result, the conveying speed of the conveying means 1A is accelerated to u1=uK. The accelerated rotation is transferred from the power transmitting means 800 to the toothed pulley 284, causing the projection 284A to rotate, as shown in FIG. 12A. The projection 284A is rotating at a higher speed than the projection 288A. Therefore, on contacting one end of the projection 288A at, e.g., a point a, the projection 284A causes the drive transmitting member 288 to rotate in the locking direction C in abutment against the projection 288A. As shown in FIG. 12B, when the one-way clutch 382 locks, the conveying means 1A starts rotating by following the rotation of the conveying means 2A.

After the acceleration, all the conveying means 64, 1A and 2A shown in FIG. 10B rotate at the same speed u1=u2=uK. When the drive shaft 21 is accelerated, the one-way clutch 381 causes the gear 29 to slip on the drive shaft 21, so that the rotation of the gear 28 is not transferred to the drive shaft 21 although the motor 26 is rotating.

Whether the sheet 7 extends over both of the conveying means 1A and 2A or not, the conveying speeds of the conveying means 1A and 2A can be increased only if the speed of the motor 46 is controlled. This can be done without causing the sheet 7 to be pulled between the conveying means 1A and 2A and therefore insures crease-free, reliable conveyance. Because the motor 26 does not have to be controlled, the control system is simple. Further, a variable-speed motor, which would increase the cost, does not have to be applied to the motor 26.

Figure 10C:
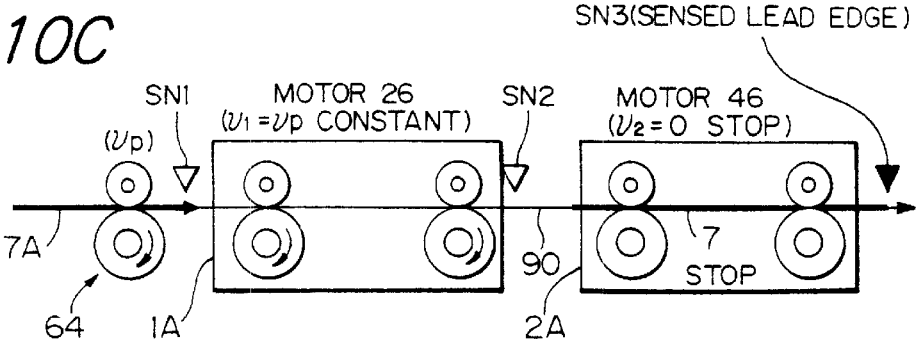

As shown in FIG. 10C, when the sheet sensing means SN3 senses the trailing edge of the sheet 7, the control means 45, FIG. 8, stops driving the motor 46 and thereby interrupts the drive transfer from the conveying means 2A to the conveying means 1A, determining that the sheet 7 does not extend over both of the conveying means 1A and 2A. At this instant, the motor 26 is still rotating. This, coupled with the fact that the toothed pulley 284 is freely rotatable relative to the drive shaft 21, causes the conveying means 1A to restore the initial conveying speed up, as shown in FIG. 10C. This allows the sheet 7A following the sheet 7 to be smoothly transferred from the conveying means 64 to the conveying means 1A.

Figure 10D:
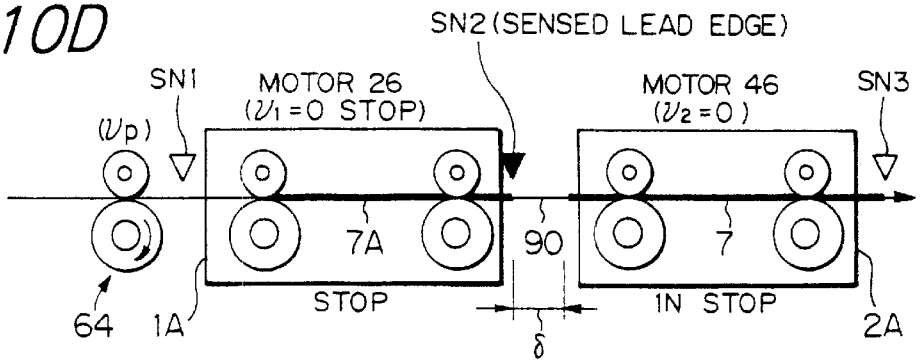

As shown in FIG. 10D, when the sheet sensing means SN2 senses the leading edge of the sheet 7A, the control means 45 stops driving the motor 26. Consequently, the sheet 7A can be stopped on the path 90 at a distance of δ from the preceding sheet 7.

As shown in FIG. 1C, when the motor 46 stops rotating, the toothed pulley 284 and therefore the projection 288A also stops rotating. However, because the motor 26 is still rotating, the rotation of the gear 29 is transferred to the drive shaft 21 via the one-way clutch 381, preventing the drive shaft 21 from stop rotating. At this instant, the one-way clutch 382 makes the drive transmitting member 288 free to rotate, so that some idle torque available with the clutch 382 causes the member 288 to start rotating clockwise together with the drive shaft 21. Consequently, as shown in FIG. 12*d*, the projection 288A makes substantially one full rotation and then stops rotating on abutting against the projection 284A at, e.g., a point b. In this condition, only the drive shaft 21 rotates and causes the conveying means 1A to convey the sheet 7A. As shown in FIG. 10D, when the motor 26 stops rotating, the projections 284A and 388A stop rotating in abutment against each other.

In the illustrative embodiment, too, when the sheet 7 extends over both of the conveying means 1A and 2A, the drive means 3 and conveying means 1A slip on each other while the conveying means 2A rotate at a higher speed than the conveying means 1A by being driven by the motor 46. The accelerated rotation of the conveying means 2A is transferred to the conveying means 1A and causes it to perform the acceleration rotation also, conveying the sheet 7 at the increased speed.

Figures 11A, 11B, 11C, 11D:
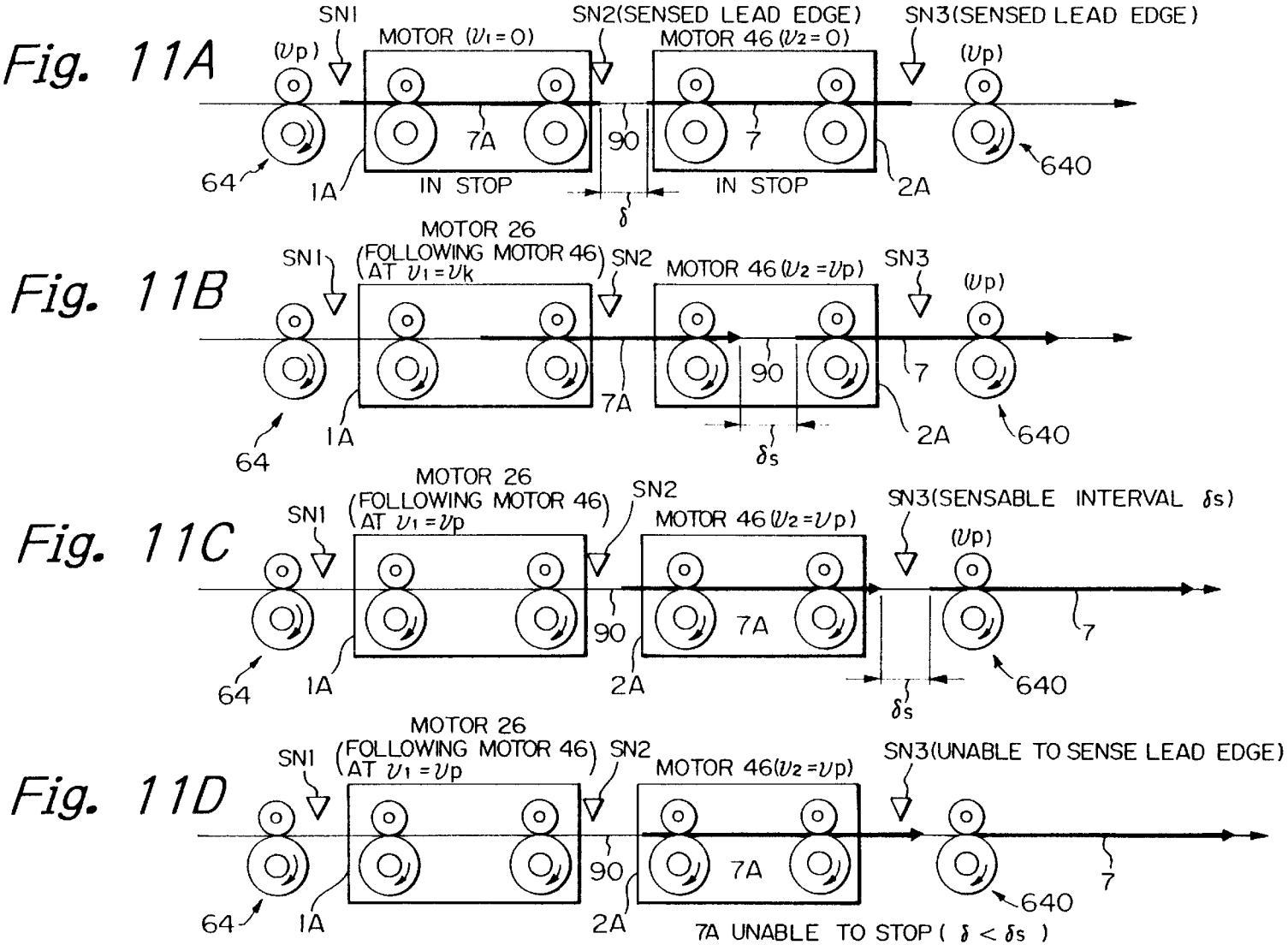
FIGS. 11A through 11D demonstrates another specific operation of the sixth embodiment.

FIGS. 11A through 11D show a system additionally including conveying means 640 positioned on the path 90 downstream of the sheet sensing means SN3 and driven by a motor not shown. As for the rest of the configuration, the system of FIGS. 11A through 11D is identical with the system of FIGS. 10A through 10D. Specifically, FIGS. 11A through 11D demonstrate how the sheets 7 and 7A staying on the path 90 and spaced from each other by the distance δ are again conveyed. FIG. 11A corresponds to FIG. 10D. The distance δ is great enough to prevent the sheet sensing means SN3 from surely sensing the leading edge of the sheet 7A.

Assume that the rotation of the motor 46 is accelerated in the condition shown in FIG. 11A, and that the motor, not shown, drives the conveying means 640 at the speed up. Then, the rotation of the motor 46 is transmitted from the conveying means 2A to the conveying means 1A with a delay ascribable to the delaying means 300, FIG. 8. More specifically, as shown in FIG. 11E, when the motor 45 is driven, the toothed pulley 28 starts rotating. At this time, the projection 288A of the drive transmitting member 288 is held stationary by the drive shaft 21 due to the idle torque of the one-way clutch 382, as stated earlier. The projection 284A rotates toward the stationary projection 288A by the idle rotation angle θ and again abuts against the end of the projection 288A at, e.g., a point c shown in FIG. 12F. Consequently, the rotation of the motor 46 is transferred from the conveying means 2A to the conveying means 1A with a delay corresponding to the idle rotation angle θ. The sheet 7 is therefore conveyed before the sheet 7A, so that the distance δ between the sheets 7 and 7A is increased to δs by the idle rotation angle θ.

Assume that the sheet conveying device lacks the delaying means 300. Then, as shown in FIG. 11D, the distance δ cannot be increased. Therefore, if the distance between nearby conveying means is reduced or if the sheet sensing means SN3 is not accurately located, then the sensing means SN3 cannot surely sense the leading edge of the sheet 7A. By contrast, when the distance δ can be increased to δs, as shown in FIG. 11C, the sheet sensing means SN3 surely senses the leading edge of the sheet 7A. When the sensing means SN3 senses the leading edge of the sheet 7A, the motor 45 is caused to stop rotating and, in turn, causes the sheet 7A being nipped by the conveying means 2A to stop on the path 90, as stated earlier.

As stated above, even when the sheets 7 and 7A are spaced by the distance δ that does not allow the sheet sensing means SN3 to sense the leading edge of the sheet 7A, the delaying means 300 causes the conveying means 1A to start operating later than the conveying means 2A. The distance δ can therefore be easily varied to δs to promote the accurate detection of the sheet 7A, thereby guaranteeing reliable conveyance. Further, low cost, reliable conveyance is achievable because no sophisticated control is necessary over the motors 26 and 46 and because the mechanical arrangement is simple.

A specific scheme that allows the distance δ to be more surely adjusted is as follows. Assume that the projections 284A and 288A are held in the condition shown in FIG. 12G at the initial stage, e.g., before the start of a job. Then, a particular order in which the motors 26 and 46 should be driven is determined. For example, if the motor 46 is driven before the motor 26, then the projection 284A can abut against the end of the projection 288A. This stabilizes the idle rotation angle θ and therefore the adjustment of the distance δ.

Seventh Embodiment

Figure 13A:
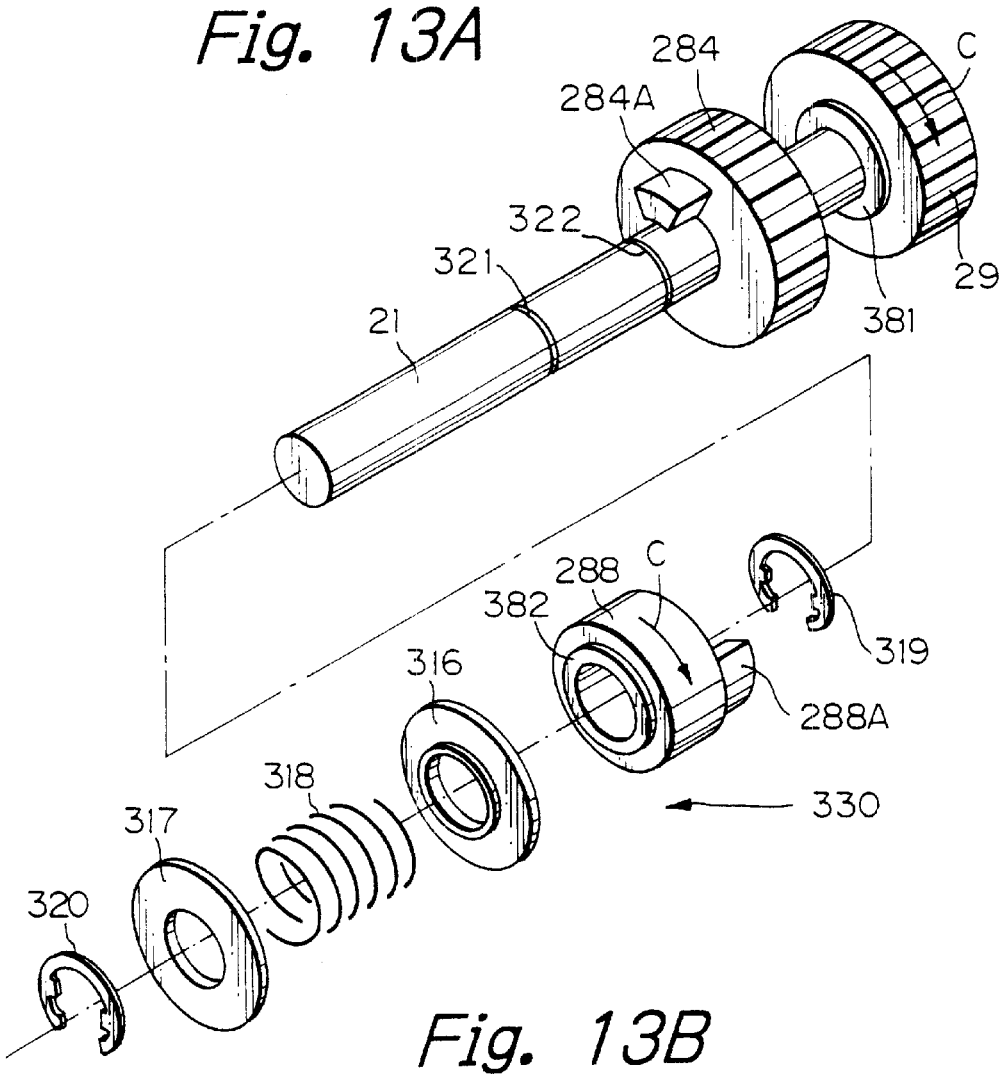
FIG. 13A is an exploded isometric view showing torque increasing means representative of a seventh embodiment of the present invention.
Figure 13B:
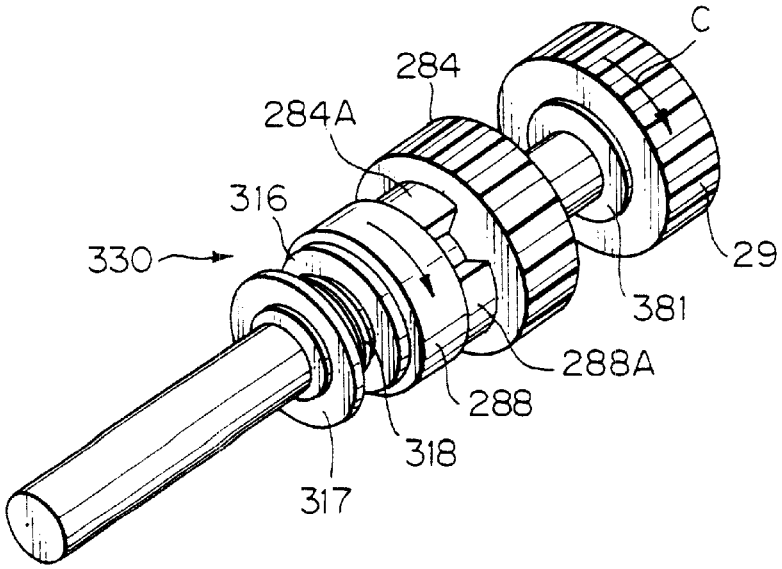
FIG. 13B is an isometric view showing the torque increasing means in an assembled condition.

FIGS. 13A and 13B show still another alternative embodiment of the present invention identical with the sixth embodiment except for the following. As shown, the illustrative embodiment additionally includes torque increasing means 330 that increases the force for causing the projection 288A to rotate when the rotation of the motor 46 is transmitted to the conveying means 1A. The torque increasing means 330 uses the idle rotation torque of the one-way clutch 382 mounted on the drive transmitting member 288. When consideration is given to the stable following ability in a high speed range, a load, which is the idle rotation torque plus a, may be given in order to increase the force that causes the projection 288A to follow the rotation of the drive shaft 21.

The torque increasing means, or load biasing means, includes spacers 316 and 317 coupled over the drive shaft 21 at the opposite side to the projection 288A. A coil spring 318 is wound round the drive shaft 21 and compressed between the spacers 316 and 317. The biasing force of the coil spring 318 exerts resistance on the sliding movement of the drive transmitting member 288 as a load of plus α. E-rings 319 and 320 are respectively received in annular grooves 322 and 321 formed in the drive shaft 21. The E-rings 319 and 320 restrict the axial movement of the members intervening therebetween.

Figure 12C:
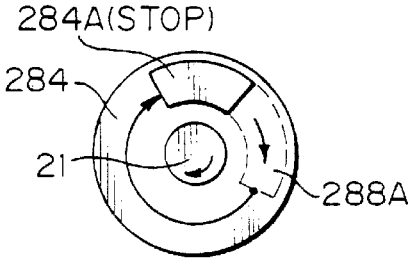
Figure 12D:
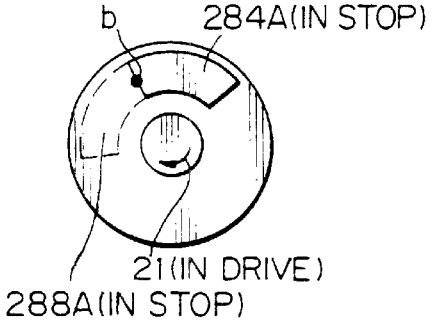
Figure 12E:
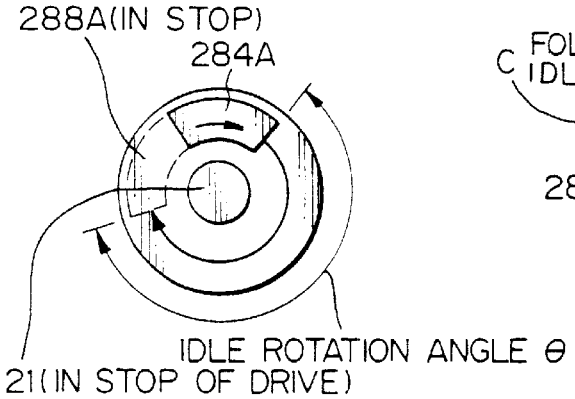
Figure 12F:
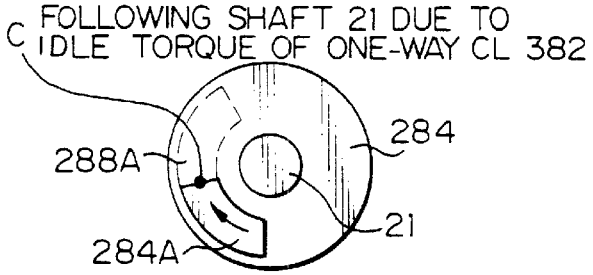
Figure 12G:
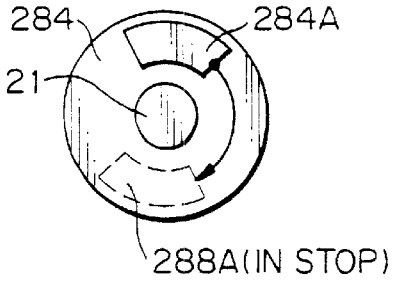

Even when the drive shaft 21 rotates at a high speed, the torque increasing means 330 allows the projection 288A to surely follow the rotation of the shaft 21, as shown in FIG. 12C. This successfully stabilizes the idle rotation angle θ at the time when conveyance is resumed, and thereby insures stable adjustment of the distance.

Figure 14A:
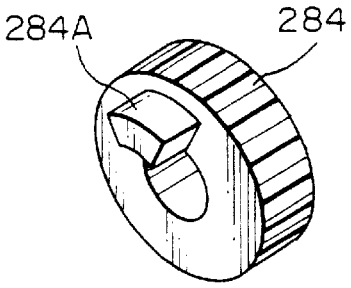
FIG. 14A is an enlarged isometric view showing a specific configuration of a first engaging member constituting delaying means in the seventh embodiment.
Figure 14B:
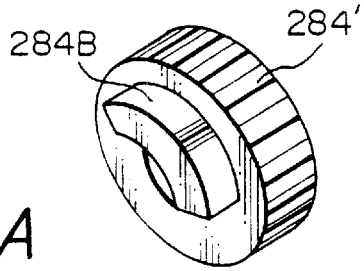
FIG. 14B is a view similar to FIG. 14A, showing another specific configuration of the first engaging member.

The amount by which the distance is adjusted by the delaying means, i.e., the idle rotation angle θ can be readily adjusted in terms of the angle between the opposite ends of the projection 284A whose center coincides with the axis of the drive shaft 21. For example, FIGS. 14A and 14B respectively show the drive transmitting member 284 with the projection 284A and a drive transmitting member 284' with a projection 284B longer (greater in angle) than the projection 284A in the circumferential direction. The drive transmitting member 284 increases the idle rotation angle θ while the drive transmitting member 284' reduces it. The drive transmitting members 284 and 284' are selectively mounted on the drive shaft 21 in accordance with a desired distance δs. The distance δs can therefore be easily adjusted.

Eighth Embodiment

Figure 15A:
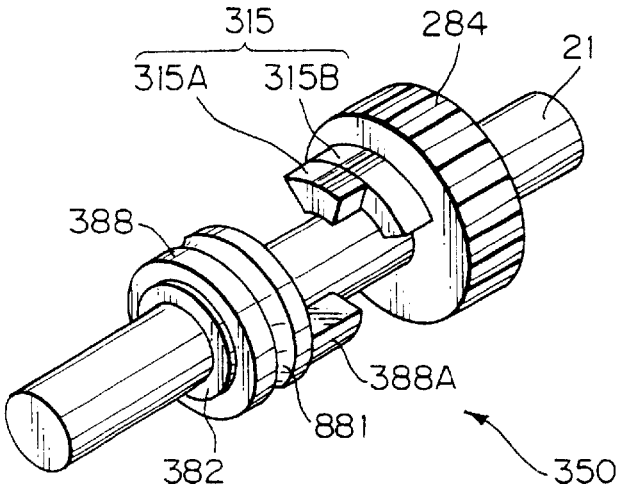
FIG. 15A is an isometric view showing a first and a second engaging member constituting delay adjusting means included in an eighth embodiment of the present invention.
Figure 15B:
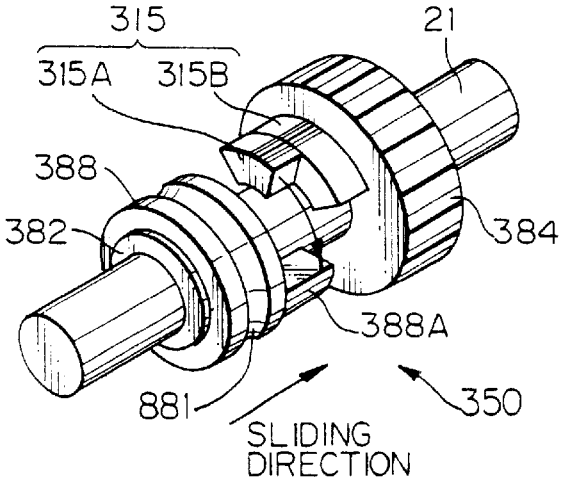
FIG. 15B is an enlarged isometric view showing that the first and second engaging members are engageable with each other.
Figure 15C:
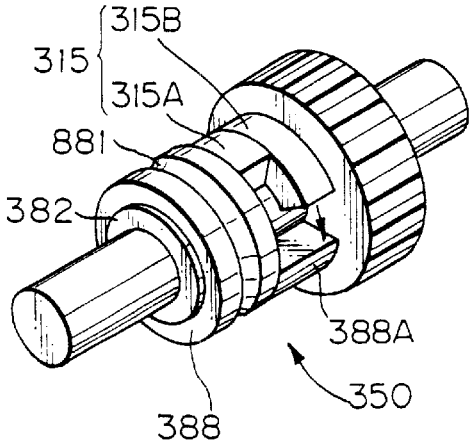
FIG. 15C in a view similar to FIG. 15B, showing the first and second engaging members ready to engage with each other.

Referring to FIGS. 15A through 15C, yet another alternative embodiment of the present invention is shown that is also identical with the sixth embodiment except for the following. As shown, the illustrative embodiment additionally includes delay adjusting means 350 for selectively varying the idle rotation angle θ, i.e., an amount by which the transfer of the rotation of the motor 46 to the conveying means 1A is delayed. The delay adjusting means 350 includes a first engaging member 315 rotatable integrally with the toothed pulley 284, which constitutes the power transmitting means 800. The first engaging member 315 includes a first and a second engaging portion 315A and 315B. A second engaging member 388A is engageable with the first and second engaging portions 315A and 315B and rotatable integrally with the one-way clutch 382. Moving means 360 selectively moves the engaging member 388A relative to the toothed pulley 284.

The engaging members 315 and 388A protrude toward each other from the facing surfaces of the toothed pulley 284 and drive transmitting member 388, respectively. In the illustrative embodiment, the one-way clutch 382 is axially slidably mounted on the drive shaft 21. The first and second engaging portions 315A and 315B are arcuate like the projections 284A and 284B. The first engaging portion 315A protrudes from the end face of the second engaging portion 315B. The engaging portions 315A and 315B may be molded integrally with each other or may be produced independently of each other and joined later. In the illustrative embodiment, the first engaging portion has a smaller circumferential length (angle) than the second engaging portion 315B.

The engaging member 388A is arcuate like the projection 288A and slidable on the drive shaft 21 over a distance great enough to engage with the second engaging portion 315B. It follows that the idle rotation angle θ and therefore the distance δs is greater when the first engaging portion 315A and engaging member 388A engage than when the second engaging portion 315B and engaging member 388A engage.

Figure 16A:
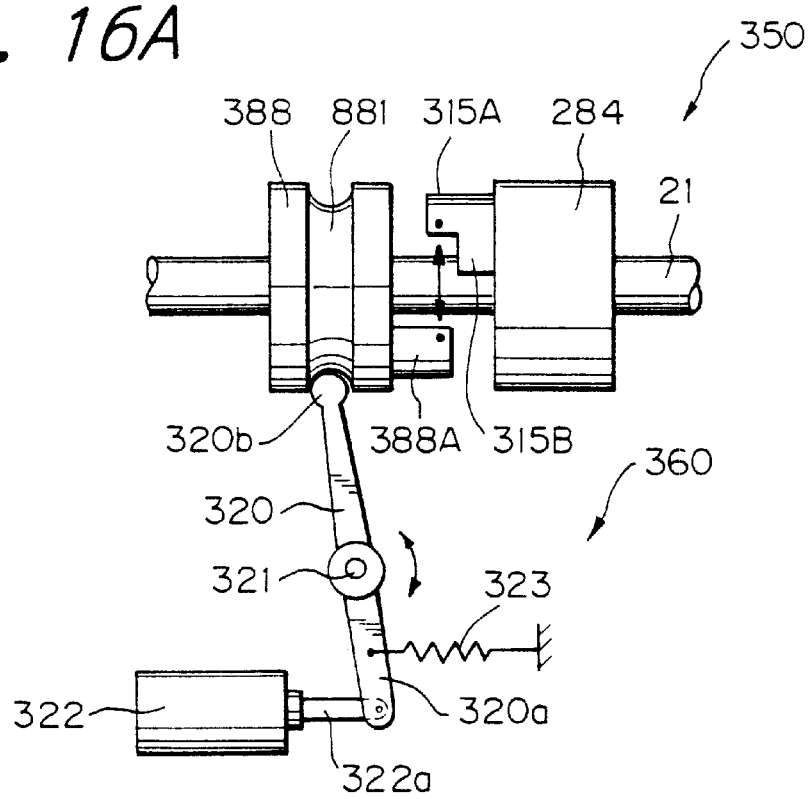
FIG. 16A is an enlarged view showing the delay adjusting means and moving means included in the eighth embodiment.
Figure 16B:
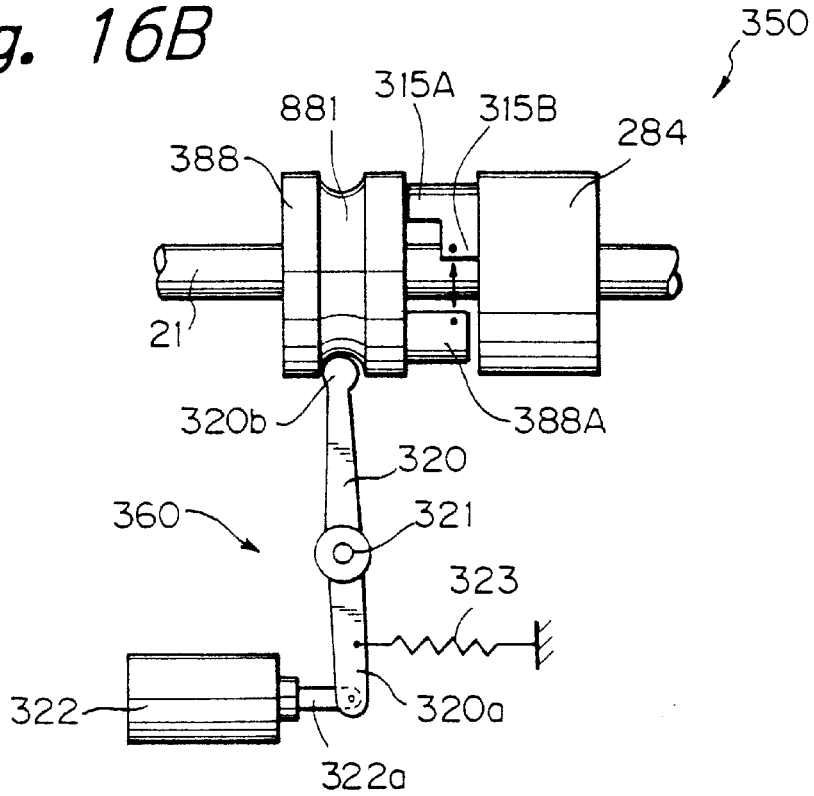
FIG. 16B is an enlarged view demonstrating the operation of the delay adjusting means.

As shown in FIGS. 16A and 16B, the moving means 360 includes an electromagnetic solenoid or drive source 322, an arm 320, and a tension spring or biasing means 323 constantly biasing the arm 320 to its initial position shown in FIG. 16A. A shaft 321 supports the intermediate portion of the arm 320 such that the arm 320 is rotatable clockwise and counterclockwise. One end 320*a* of the arm 320 is pinned to a plunger 322*a* protruding from the solenoid 322. The other end of the arm 320 is spherical and received in an annular groove 881 formed in the circumference of the drive transmitting member 388 and having a hemispherical cross-section. This configuration reduces resistance to the sliding movement of the drive transmitting member 388 on the arm member 320 when the member 388 rotates. Considering the wear of such members and smooth operation, a lubricant should preferably be applied to the end 320*b* and groove 881. The solenoid 322 is of a pull type that pulls the plunger 322*a* when energized.

When the solenoid 322 is deenergized, the arm 320 is held in a first position where the first engaging portion 315A and engaging member 388A are engageable, as shown in FIG. 16A, under the action of the tension spring 323. When the solenoid 322 is energized, the arm 320 is moved to a second position where the second engaging portion 315B and engaging member 388A are engageable, as shown in FIG. 16B.

In the delay adjusting means 350 described above, by adequately ON/OFF controlling the solenoid 322, it is possible to shift the engaging member 388A and therefore to easily vary the idle rotation angle, i.e., the distance δs.

Two engaging portions 315A and 315B are, of course, illustrative and may be replaced with three or more engaging portions. The delaying means 300 or the delay adjusting means 350 adjust the idle rotation angle θ by varying the circumferential size (angle) of the projections 284A and 284B or that of the engaging portion 315 provided on the toothed pulley 284 or 284'. Alternatively, the circumferential size (angle) of the projection 288A or 388A provided on the drive transmitting member 288 or 388 may be varied for adjusting the idle rotation angle θ.

Ninth Embodiment

Figure 17:
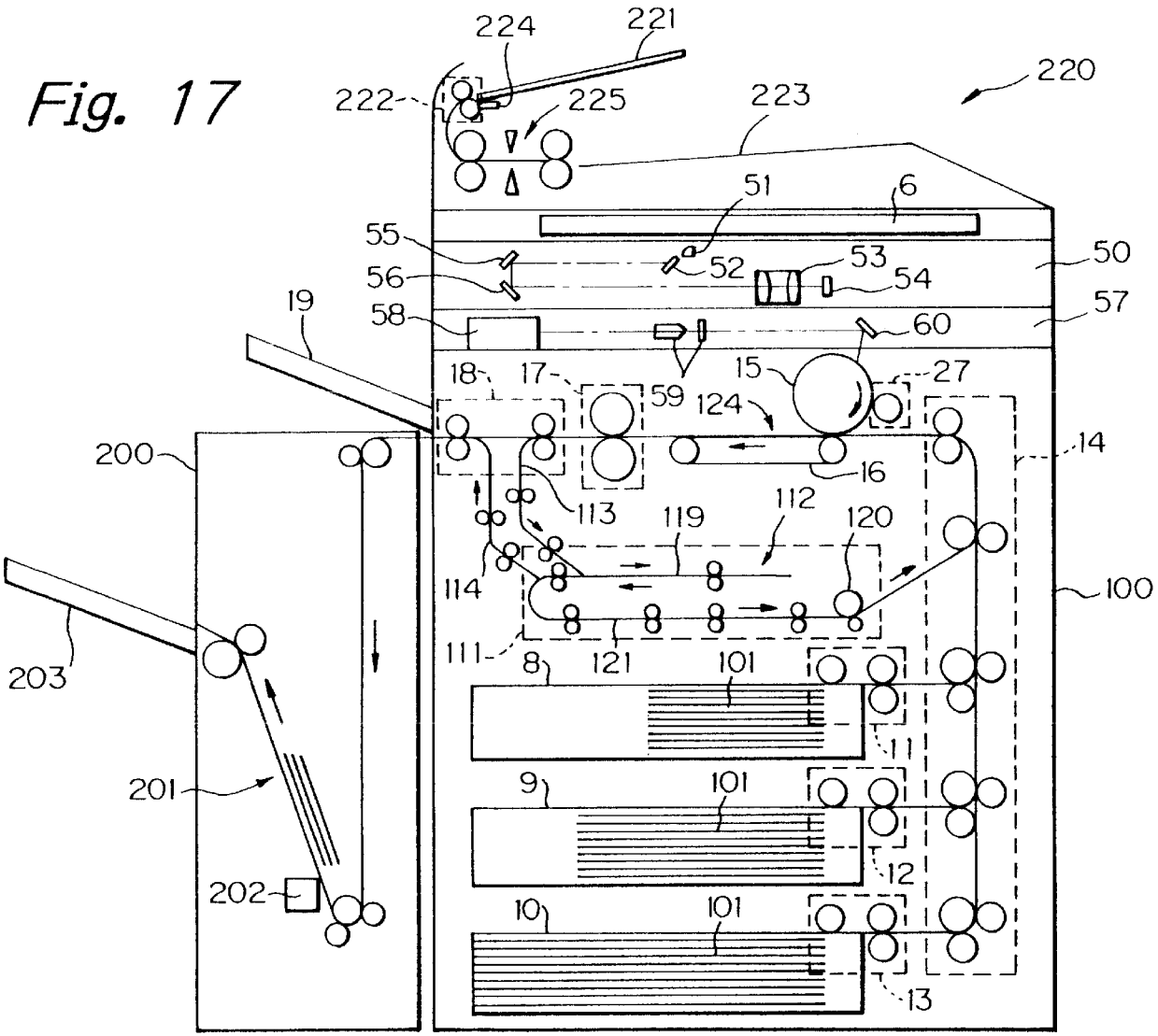
FIG. 17 shows an image forming apparatus representative of a ninth embodiment of the present invention.

Reference will be made to FIG. 17 for describing a further alternative embodiment of the present invention implemented as a digital copier, which is a specific form of an image forming apparatus. As shown, the digital copier includes a reading unit 50, an automatic document reading device 220, a writing unit 57, a finisher 200, and a duplex copy conveying unit 111 to which the present invention is applied. The copier is capable of forming images on both sides of a paper sheet or similar sheet 101 in a duplex copy mode.

The copier has a frame 100 accommodating a photoconductive drum 15, which is a specific form of an image carrier. The reading unit 50 is positioned above the drum 15 for scanning a document set on a glass platen 6. The reading unit 50 includes scanning optics in addition to the glass platen 6. The scanning optics includes a lamp 51, a first to a third mirror 52, 55 and 56, a lens 53, a CCD (Charge Coupled Device) image sensor 54 and other conventional constituents. The lamp 51 and first mirror 52 is mounted on a first carriage, not shown, while the second and third mirrors 55 and 56 are mounted on a second carriage not shown. To read a document image, the first and second carriages are mechanically moved at a speed ratio of 2:1 in order to prevent the length of an optical path from varying. A scanner motor, not shown, drives the scanning optics.

The automatic document reading device 220 is positioned in the upper portion of the frame 100 for automatically reading a sheet document. In the automatic document reading device 220, a feed roller pair 222 feeds a document laid on a tray 221 toward an image sensor 225. While the document is conveyed via the image sensor 225 at a constant speed, the image sensor 225 reads an image existing on the front side of the document. Image data output from the image sensor 225 are subjection to various kinds of processing including MTF (Modulation Transfer Function) correction, filtering and compression and sequentially written to an image memory 66 (see FIG. 18). In the illustrative embodiment, the image sensor 225 is implemented by a contact type, x1 CCD image sensor.

Figure 18:
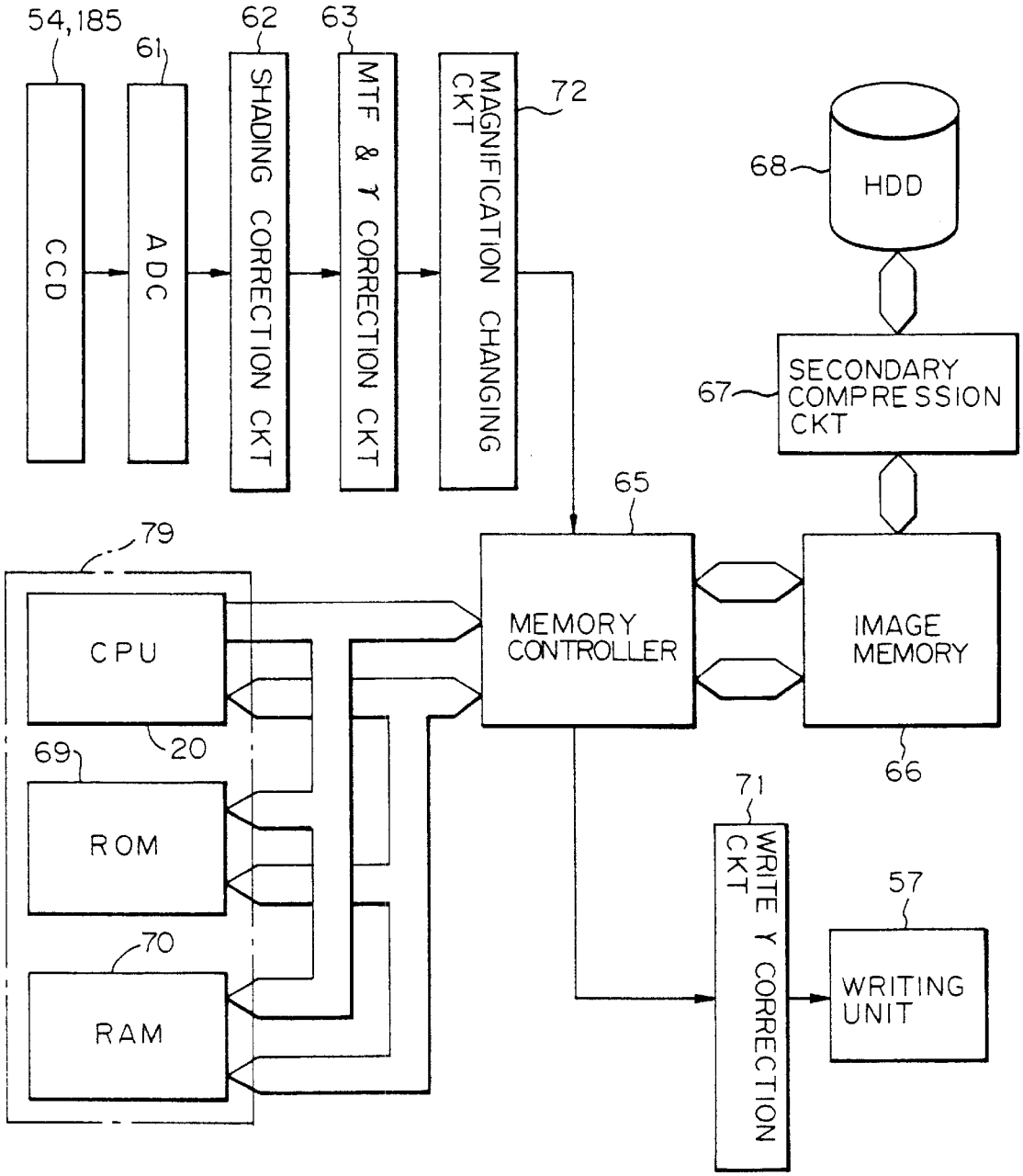
FIG. 18 is a block diagram showing an image processing section and control means included in the ninth embodiment.

FIG. 18 shows a specific configuration of an image processing section. As shown, the image processing section includes an analog-to-digital converter (ADC) 61 for converting an analog image signal output from the CCD image sensor 54 or the image sensor 225 to a digital signal or image data. A shading correcting circuit 62 corrects the shading of the image data. An MTF and γ correcting circuit 63 executes MTF and γ correction with the image data output from the shading correcting circuit 62. A magnification changing circuit 72 enlarges or reduces the size of the image data in accordance with a desired magnification change ratio and delivers the resulting image data to a memory controller 65. The memory controller 65 writes the image data in the previously mentioned image memory 66 while executing primary compressing with the image data. The procedure described so far is continuously effected until all the image data of the page have been fully written to the image memory 66.

A secondary compression circuit 67 executes secondary compression with the image data read out of the image memory 66 in order to reduce the amount of image data, as needed. The image data subjected to secondary compression are written to a HDD (Hard Disk Drive) 68 or similar storage. The HDD 68 may be replaced with, e.g., a DVD (Digital Versatile Disk)-RAM (Random Access Memory), CD (Compact Disk)-RW (Readable, Writable), Smart Media, compact flush memory, memory card or similar optical or magnetic storage. The image data stored in the HDD 68 can be repeatedly read out, so that documents should only be read once even when a plurality of sets of copies are desired. To print the image data stored in the image memory 66, the image data are fed from the image memory 66 to the memory controller 65. The memory controller 65 transfers the image data to the writing unit 57 via a write γ correcting unit 71.

When a sort mode is selected, images of documents being sequentially read are written to the HDD 68. In this case, it is important to note that for the first set of copies, i.e., when printing is effected simultaneously with document reading, image data are simply written to the HDD 68 without being rearranged in the image memory 66. Specifically, because the HDD 68 accessible only in one direction, batting of the storage in the ADD 68 and the rearrangement in the image memory 66 should be avoided as far as possible in order to enhance productivity. For this reason, the image memory 66 is not released until all the image data have been written to the HDD 68.

Referring again to FIG. 17, the writing unit 57 includes a laser unit 58, a lens 59, and a mirror 60. The laser unit 58 includes a laser diode and a polygonal mirror caused to rotate at a constant speed by a motor, although not shown specifically. A laser beam issuing from the writing unit 57 is incident to the circumferential surface of the drum 15, which constitutes major part of an image forming section.

An image formed by the image forming section is printed on the sheet 101 by the following procedure. A first to a third tray 8 through 10 are disposed in the frame 100, and each is loaded with a stack of sheets 101 of particular size. The trays 8 through 10 may, of course, be loaded with sheets 100 of the same time. A first to a third paper feeder 11 through 13 each pay out the sheet 101 from associated one of the trays 8 through 10. A vertical conveying unit 14, which extends in an intended direction of sheet feed, conveys the sheet 101 to a path 124 that includes an image transfer position.

While a main motor 25, which will be described later, rotates the drum 15 at a constant speed, the writing unit 57 emits a laser beam in accordance with the image data read out of the image memory 66. The laser beams scans the surface of the drum 15 to thereby form a latent image. A developing unit 27, adjoining the drum 15, develops the latent image with toner to thereby produce a corresponding toner image. A belt 16 arranged on the path 124 conveys the sheet 101 at a speed equal to the rotation speed of the drum 15. The toner image is transferred from the drum 15 to the sheet 101 when the sheet 101 is brought to the image transfer position where the drum 15 is located. The belt 16 further conveys the sheet 101 to a fixing unit 17 located downstream of the belt 16. The fixing unit 17 fixes the toner image on the sheet 101. The sheet 101 with the fixed toner image is further conveyed to a sheet discharge unit 18. It is to be noted that in the illustrative embodiment the conveying speed of the image forming section (process speed) refers to the speed at which the drum 15, belt 16 and vertical conveying unit 14 convey the sheet 101. The conveying speed of the image forming section is dependent on the specifications of the apparatus.

The sheet 101 coming out of the fixing unit 18 is routed to a destination that depends on the kind of processing to follow. If no particular processing is selected by the operator, then the sheet 101 is simply driven out to a copy tray 19 via the paper discharge unit 18 as a simplex or one-sided copy. When a duplex copy mode or a mode using the finisher 200 is selected, the sheet discharge unit 18 steers the sheet 101 toward the duplex copy conveying unit 111.

The duplex copy conveying unit (simply conveying unit hereinafter) 111 and arrangements around it will be described specifically hereinafter. The conveying unit 111 is arranged between the tray 8 and the fixing unit 17. The conveying unit 111 and sheet discharge unit 18 are connected to each other by an inlet path 113 and an outlet path 114. The sheet 101 from the sheet discharge unit 18 is introduced into the conveying unit 111 via the inlet path 113. The sheet 101 from the conveying unit 111 is conveyed to the sheet discharge unit 18 via the outlet path 114.

In a duplex copy mode, the sheet discharge unit 18 steers the sheet 101 carrying an image on one side thereof to a switchback path 119 via the inlet path 113. The sheet 101 is further conveyed to a reversing unit or reversing section 112. An intermediate path 121 is contiguous with the switchback path 119 for receiving the sheet 101 reversed by the reversing unit 112. The sheet 101 is again conveyed from the intermediate path 121 to the image transfer position via the vertical conveying unit 14.

In a mode using the finisher 200, the sheet 101 reversed by the reversing unit 112 is guided into the outlet path 114 also contiguous with the switchback path 119 and then into the finisher 200 via the sheet discharge unit 14. When the sheet 101 is to be stapled in the finisher 200, it is once stacked on a stack tray 201. After all sheets 101 to be dealt with have been stacked on the stack tray 201, a stapler unit 202 staples the stack of sheets 101. The stapled stack 101 is driven out to a tray 203 mounted on the outside of the finisher 200.

Figure 19:
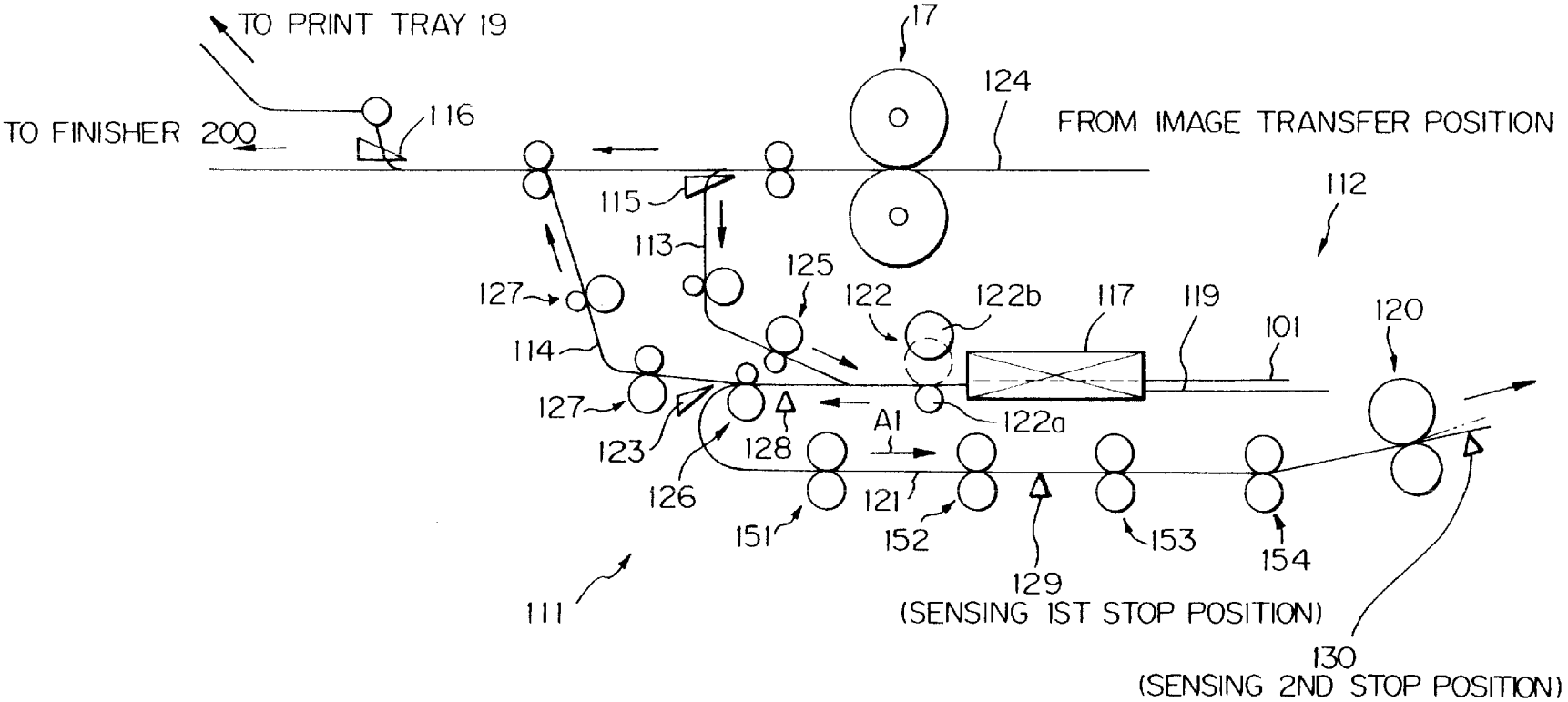
FIG. 19 shows arrangements around a duplex copy conveying unit including in the ninth embodiment together with sheet conveyance paths.

More specifically, as shown in FIG. 19, a path selector 115 for steering the sheet 101 is located at a position where the inlet path 113 and path 124 join each other. The path selector 115 is movable into and out of the path 124. When the path selector 115 moves into the path 124, it steers the sheet 101 toward the inlet path 113 without guiding it to the copy tray 19. Inlet conveying means 125 conveys the sheet 101 introduced into the inlet path 113 to the switchback path 119 of the reversing unit 112.

The reversing unit 112 includes a jogger 117. After a single sheet 101 has reached the switchback path 119, the jogger 117 positions opposite sides of the sheet 101. Subsequently, return conveying means 122 arranged on the switchback path 119 drives the sheet 101 out of the switchback path 119.

A path selector 123 is located at a position where the outlet path 114 and intermediate path 121 join each other. The path selector 123 is movable to select either one of the outlet path 114 and intermediate path 121. Specifically, when the path selector 123 moves into the outlet path 114, it steers the sheet 101 coming out of the switchback path 119 toward the intermediate path 121. When the path selector 123 moves into the intermediate path 121, it steers the sheet 101 to the outlet path 114.

Conveying means 151, 152, 153 and 154 are sequentially arranged on the intermediate path 121. The conveying means 151 through 154 cooperate with conveying means 120 to convey the sheet 101 introduced into the intermediate path 121 toward the vertical conveying unit 14. The vertical conveying unit 14 again transfers the sheet 101 to the path 124. As a result, a toner image is formed on the other side or rear side of the sheet 101 at the image transfer position. After the fixing unit 17 has fixed the toner image on the rear side of the sheet 101, the sheet 101 is driven out to the tray 19 via the path 124. At this instant, the path selector 115 has retracted from the path 124.

The return conveying means 122 on the switchback path 119 is implemented by a drive roller 122*a* positioned below the path 119 and a driven roller 122*b* positioned above the path 119 and movable into and out of contact with the drive roller 122*a*. The return conveying means 122 allows a sheet 101 entering the switchback path 119 and a sheet 101 leaving the path 119 to pass each other on the path 119. At this instant, outlet conveying means or roller pair 126 fully grips the sheet 101 leaving the path 119 (preceding sheet) At the same time, while the jogger 117 is retracted, the inlet conveying means 125 conveys the sheet 101 entering the path 119 (following sheet) into the switchback path 119. A sheet sensor or sheet sensing means 128 is positioned upstream of the outlet conveying means 126. Control means 79, which will be described later, determines whether or not the sheet 101 has reached the outlet conveying means 126 on the basis of the output of the sheet sensor 128.

To simply reverse and discharge the sheet 101, the path selector 123 steers the sheet 101 reversed by the reversing unit 112 to the outlet path 114. As a result, the sheet 101 is returned to the path 124.

Another path selector 116 is positioned on the path 124 downstream of the path selector 115 for guiding the one sided, two-sided or reversed sheet 101 to either one of the copy tray 19 and finisher 200.

The conveying unit 111 is implemented by any one of the first to fifth embodiments. In the illustrative embodiment, the conveying unit 111 is similar in construction to the third embodiment shown in FIG. 5.

Figure 20:
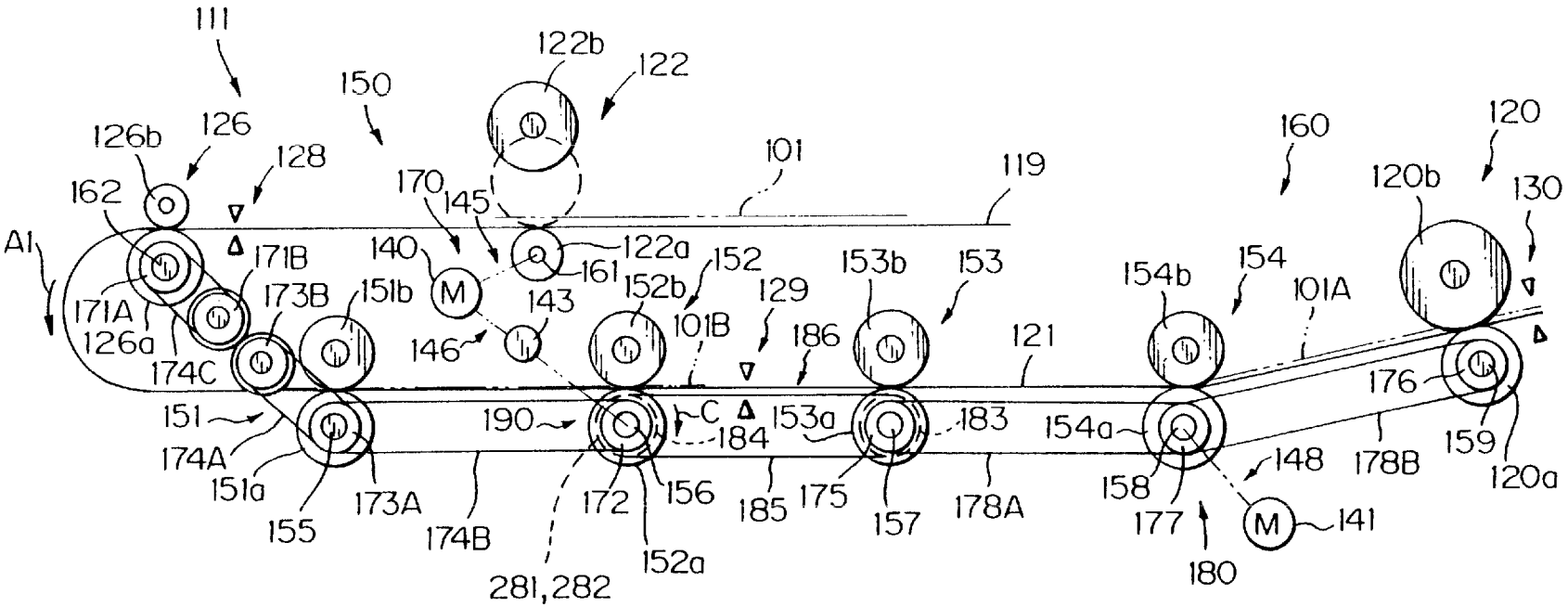
FIG. 20 is an enlarged view showing essential part of the duplex copy conveying unit included in the ninth embodiment.

Specifically, as shown in FIG. 20, the conveying unit 111 includes upstream conveying means 150, downstream conveying means 160, first and second drive means 170 and 180 for respectively driving the conveying means 150 and 160, and speed adjusting means 190. The upstream conveying means 150 is made up of the return conveying means 122, outlet conveying means 126, and conveying means 151 and 152. The downstream conveying means 160 is made up of the conveying means 153 and 154 and outlet conveying means 120.

The return conveying means 122 has a drive roller 122*a* positioned below the switchback path 119 and a driven roller 122*b* facing the drive roller 122*a*. Likewise, the outlet conveying means 126 has a drive roller 126*a* positioned below the switchback path 119 and a driven roller 126*b* facing the drive roller 126*a*. The drive rollers 122*a* and 126*a* are respectively mounted on drive shafts 161 and 162 each extending across the switch back path 119.

The conveying means 151 through 154 respectively have drive rollers 151*a* through 154*a* positioned below the intermediate path 121 and driven rollers 151*b* through 154*b* respectively facing the drive rollers 151*a* through 154*a*. The outlet conveying means 120 has a drive roller 120*a* positioned below the intermediate path 121 and a driven roller 120*b* facing the drive roller 120*a*. The drive rollers 151*a* through 120*a* are respectively mounted on drive rollers 155 through 159 each extending across the intermediate path 121.

The drive means 170 mentioned earlier includes an electric motor 140 and transmission mechanisms 145 and 146 connecting the output shaft of the motor 140 to the drive shafts 161 and 156, respectively. The transmission mechanisms 145 and 146 each are implemented by a particular gear train. The other drive means 180 includes an electric motor 141 and a transmission mechanism 148 connecting the output shaft of the motor 141 to the drive shaft 158. The motor 140 is driven at a constant speed equal to the conveying speed or process speed of the image forming section. The motor 141 is driven at a variable speed.

The speed adjusting means 190 causes the conveying speed of the conveying means 150 to reflect the conveying speed of the conveying means 160, which is varied by the drive means 180. The speed adjusting means 190 is made up of power transmitting means 186 connecting the conveying means 150 and 160 and a first and a second one-way clutch 281 and 282. The power transmitting means 186 includes a toothed pulley 183 affixed to the drive shaft 157, a toothed pulley 184 mounted on the drive shaft 156 via the one-way clutch 282, and an endless timing belt 185 passed over the pulleys 183 and 184.

The one-way clutch 281 is positioned between the drive shaft 156 and the transmission mechanism 146 in order to connect the conveying means 150 and drive means 170. The clutch 281 transmits only the rotation of the motor 140 that conveys the sheet 101 in a refeed direction A1, which is the direction of sheet conveyance in the illustrative embodiment. The one-way clutch 282 is positioned between the drive shaft 156 and the toothed pulley 184 in order to connect the conveying means 150 and 160. When the rotation of the motor 141 is accelerated for conveying the sheet 101 at an increased speed in the refeed direction A1, the clutch 282 transmits the accelerated rotation of the motor 141 to the conveying means 150. The clutches 281 and 282 are coaxially mounted on the drive shaft 156 and lock in the same direction C as each other.

The outlet conveying means 126 and conveying means 151 respectively include a toothed pulley 171A affixed to the of the drive shaft 162 and a toothed double pulley 173A affixed to the end of the drive shaft 155. A timing belt 174C is passed over the toothed pulley 171A and a pulley with a gear 171B. Likewise, a timing belt 174A is passed over the toothed double pulley 173A and a pulley with a gear 173B. The gear portion of the pulley 171B and that of the pulley 173B are held in mesh with each other, connecting the outlet conveying means 126 and conveying means 151. A toothed pulley 172 is affixed to the end of the drive shaft 156. A timing belt 174A is passed over the toothed pulley 172 and toothed double pulley 173A, connecting the conveying means 152 and 151. Toothed pulleys 175 and 176 are affixed to the ends of the drive shafts 156 and 159, respectively, while a toothed double pulley 177 is affixed to the end of the drive shaft 158. A timing belt 178A is passed over the toothed pulley 175 and the double pulley 177 while a timing belt 178B is passed over the toothed pulley 176 and double pulley 177, connecting the conveying means 153 and 154.

The transmission mechanism 146 additionally includes a clutch or coupling/uncoupling means 143 for selectively connecting or disconnecting the conveying means 152 to or from the motor 140. The clutch 143 is implemented by an electromagnetic clutch and electrically connected to a CPU (Central Processing Unit) 20 (see FIG. 21). The clutch 143 connects the transmission mechanism 146 when energized by the CPU 20 or causes one of the gears of the transmission mechanism 146 to idle when deenergized.

Figure 21:
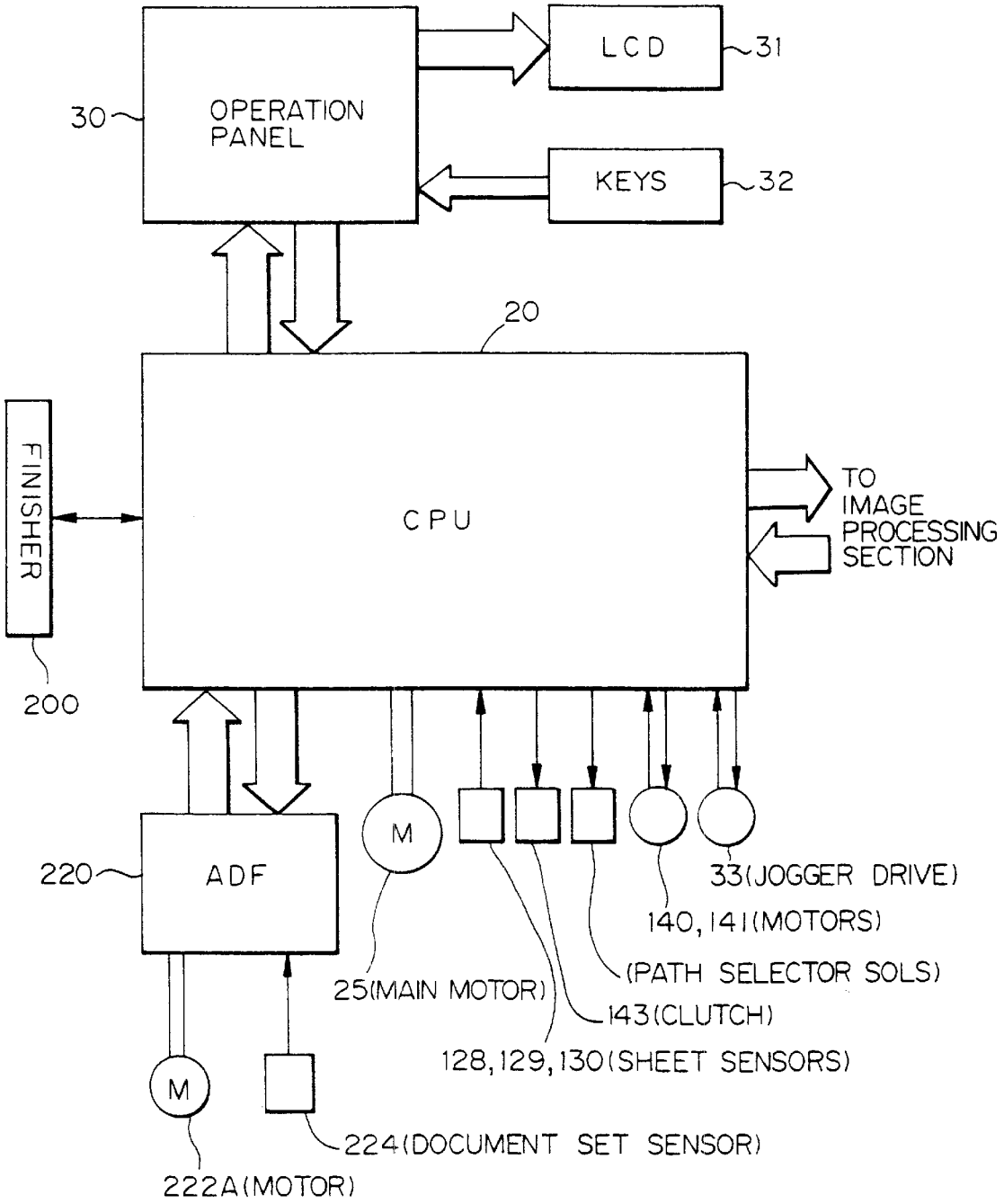
FIG. 21 is a block diagram showing essential part of a drive control device included in the ninth embodiment.

A sheet sensor or sheet sensing means 129 responsive to the leading edge of the sheet 101 faces the intermediate path 121 at a position between the conveying means 152 and 153. A sheet sensor or sheet sensing means 130 also responsive to the leading edge of the sheet 101 faces the path 121 at a position just downstream of the outlet conveying means 120. As shown in FIG. 21, the sheet sensors 129 and 130 are electrically connected to the CPU 20.

In the illustrative embodiment, the copier includes a drive control device. As shown in FIG. 18, the drive control means includes the previously mentioned control means 79 implemented by a microcomputer, which has the CPU 20, a ROM 70, and a RAM (Random Access Memory) 70. The control means 79 is connected to the memory controller 65 and controls the entire copier.

As shown in FIG. 21, an operation panel 30 and an ADF (Automatic Document Feeder) 220 mounted on the copier are connected to the CPU 20. Also electrically connected to the CPU 20 are the main motor 25 for driving the drum 15 as well as sections associated therewith, a jogger motor 33 for driving the jogger 117, the motors 140 and 141, solenoids (SOLs) or similar actuators for actuating the path selectors, the finisher 200, the sheet sensors 128 through 130, and the clutches 143 and 144. Keys 32 and a LCD (Liquid Crystal Display) 31 are connected to the operation panel 30. The operator may input a copy start command, a desired number of copies, a simplex mode command, a duplex mode command, a finish command and other various commands on the keys 32, as desired. The LCD 31 displays, e.g., the number of copies output and the various conditions of the copiers in the form of characters or graphics. Further connected to the CPU 20 are a document set sensor 224 and a motor 222A for driving the feed roller pair 222, which are included in the ADF 220. The CPU 20 interchanges data with the above various sections while driving them.

In the illustrative embodiment, the control means 79 usually controls the rotation speeds of the motors such that they convey the sheet 101 at the conveying speed (process speed) up of the image forming section. In the duplex copy mode, when the sheet 101 is to be driven out of the duplex copy conveying unit 111, the control means 79 accelerates the rotation of the motor 141 such that the sheet 101 is conveyed at a speed higher than the conveying speed up. When a plurality of duplex copies are to be produced or when interrupt processing is to be executed, the control means 79 selectively turns on or turns off the motors 140 and 141 and clutch 143 on the basis of the outputs of the sheet sensors 129 and 130.

How the conveying unit 111 conveys the sheet 101 will be described hereinafter, taking mainly the duplex copy mode as an example. As shown in FIG. 20, the one-sided sheet 101 is once stacked on the switchback path 119. At this time, the motors 140 and 141 are rotating at a constant speed. To convey the sheet 101 to the intermediate path 121, the driven roller 122*b* is pressed against the drive roller 122*a* and conveys the sheet 121 until the outlet conveying means 126 grips the leading edge of the sheet 101. Subsequently, the driven roller 122*b* is released form the drive roller 122*a* while only the rotation of the motor 141 is accelerated. At the same time, the clutch 143 is energized.

The accelerated rotation of the motor 141 is transmitted to the drive shafts 157 and 159 by the timing belts 178A and 178B, respectively. As a result, the conveying means 153 and 154 and outlet conveying means 120 are accelerated. The accelerated rotation transferred to the drive shaft 157 is further transferred to the drive shaft 156 via the power transmitting means 186 and one-way clutch 282 and is also transferred to the drive shafts 155 and 162 by the timing belts 174B, 174C and 174C. Consequently, the conveying speed of the outlet conveying means 126 and the conveying speeds of the conveying means 151 and 152 are increased. That is, after the acceleration of the motor 141, the entire conveying means 150 and 160 other than the return conveying means 122 rotate at a speed higher than the conveying speed or process speed up. As a result, the sheet 101 driven out of the switchback path 119 by the return conveying means 122 is conveyed at the increased speed until it moves away from the outlet conveying means 120. This successfully prevents productivity (printing efficiency) from being lowered.

When the rotation of the drive shaft 156 is accelerated, the one-way clutch 281 causes the transmission mechanism 146 and drive shaft 156 slip on each other. The drive shaft 156 can therefore be accelerated despite that the motor 140 is in rotation. The conveying speed of the conveying means 150 can be increased only if the rotation of the motor 141 is accelerated, i.e., without the motor 140 being controlled. This surely prevents the sheet 101 from being pulled between the conveying means 150 and 160 and therefore insures reliable conveyance. Because the motor 26 does not have to be controlled, the control system is simple. Further, the control system is simplified while the cost is reduced because the motor 140 does not have to be varied in speed.

Assume that interrupt processing occurs in the event of the duplex mode for producing a plurality of duplex copies. Then, when the sheet sensor 130 senses the leading edge of the sheet 101, the control means 79 stops driving only the motor 141 with the result that the preceding sheet 101A is brought to a stop on the intermediate path 121 at the downstream conveying means 160 side. At this instant, the motor 140 is still rotating. This, coupled with the operation of the one-way clutch 282, instantaneously switches the conveying speed of the outlet conveying means 126 and the conveying speeds of the conveying means 153 and 154 to the conveying speed (process speed) of the motor 140 although the conveying means 143, 154 and 120 stop rotating. It is therefore possible to convey the following sheet 101B to the switchback path 119 and convey another sheet 101 from the switch back path 119 to the intermediate path 121 without interruption. This is also successful to prevent productivity (printing efficiency) from being lowered.

When the sheet sensor 129 senses the leading edge of the sheet 101B entered the intermediate path 121, the control means 79 stops driving the motor 140. The two sheets 101A*a* and 101B can therefore be brought to a stop on the intermediate path 121. Alternatively, in response to the output of the sheet sensor 129, the controller 79 may deenergize the clutch 143 to thereby interrupt drive transmission from the motor 140 to the drive shaft 156.

As for the conveyance of the sheet 101 in the duplex mode, the sheet 101 may not be stacked in the conveying unit 111 (stackless conveyance) instead of being stacked in the same. A specific stackless conveyance scheme is as follows. First, after images have been printed on one side of two or more consecutive sheets 101, the sheet 101 conveyed to the conveying unit 111 first is again fed to the image transfer position to print an image on the other side of the sheet 101, thereby producing a duplex copy. Subsequently, a sheet 101 is fed from any one of the trays 8 through 10 in such a manner as to follow the duplex copy. After an image has been printed on the sheet 101 fed from the tray, the sheet or one-sided copy 101 is conveyed to the conveying unit 111. Thereafter, the feed of sheets from the tray and the refeed of one-sided copies from the conveying unit 111 are alternately effected.

The procedure described above is generally referred to as Interleaf control. Interleaf control may be applied to the illustrative embodiment in order to produce duplex copies, as follows.

<Specific Copying Order; Two-Sheet Interleaf Control> front of first sheet→front of second sheet→rear of first sheet→front of third sheet→rear of second sheet→front of fourth sheet <Specific Copying Order; Three-Sheet Interleaf Control> front of first sheet→front of second sheet→front of third sheet→rear of first sheet→front of fourth sheet→rear of second sheet Interleaf control causes the sheets 101 to exist on the paths of the copier 100. Therefore, considering creases, for example, it has heretofore been impossible to stop the sheet 101 at portions that are different in conveying speed from each other. By contrast, the illustrative embodiment includes the conveying unit 111 capable of solving the problem given rise to by a difference in conveying speed. Specifically, the illustrative embodiment is capable of stopping the sheet 101 in the conveying unit 111 and again conveying it in a desirable manner even in the event of interleaf control. The illustrative embodiment therefore prevents productivity from being lowered more than the conventional interleaf control type of image forming apparatus. In addition, the illustrative embodiment conveys the sheet 101 more smoothly than the conventional apparatus of the type described.

In the illustrative embodiment, the conveying unit 111 is arranged in the frame 100. Alternatively, any one of the first to fifth embodiments may, of course, be arranged on the path in the frame 100, preferably in a portion whose conveying speed differs from the conveying speed (process speed) up. While the conveying unit 111 is based on the third embodiment, it may, of course, be based on any other illustrative embodiment. Which embodiment should be applied to the conveying unit 111 or which sheet conveying device should be applied to the frame 100 depends on the number of conveying means, which are implemented by roller pairs, and the positions of the same.

The delaying means 300, torque increasing means 330 and delay adjusting means 350 have been shown and described as being applied to the second embodiment. Such members may, of course, be applied to any one of the sheet conveying devices represented by the embodiments shown in FIGS. 1, 5, 6 and 7 or even to the conveying unit 111 shown in FIG. 17. Further, the above members are similarly applicable to an image forming apparatus including the above-described sheet reversing device and conveying unit 111.

In summary, it will be seen that the present invention provides a sheet conveying device and an image forming apparatus including the same having various unprecedented advantages, as enumerated below.

(1) A sheet can be smoothly, surely transferred from one conveying means to another conveying means that are different in conveying speed from each other. This is also true when the sheet extends over both of such conveying means.

(2) Even when the sheet extends both of upstream and downstream conveying means, a load on the upstream conveying means is extremely light. This further promotes smooth, reliable sheet conveyance.

(3) The sheet can be brought to a stop on a path adjoining the upstream conveying means. Therefore, various kinds of sheet conveyance can be coped with and shared by different image forming apparatuses.

(4) A first and a second one-way clutch are coaxially mounted on a single shaft and therefore occupy a minimum of space.

(5) The upstream conveying means is capable of smoothly receiving another sheet, so that the advantage (3) is also achievable.

(6) Sheets can be brought to a stop on the path in the vicinity of both of the upstream and downstream conveying means, so that the advantage (3) is also achievable.

(7) Even when the sheet extends over both of the upstream and downstream conveying means, not only smooth, reliable sheet conveyance is insured, but also productivity or printing efficiently is prevented from being lowered.

(8) The distance between consecutive sheets can be easily adjusted for thereby further enhancing reliable sheet conveyance.

(9) The distance between consecutive sheets can be stably adjusted because the upstream conveying means can follow a driving force transferred thereto even at a high speed.

Various modifications will become possible for those skilled in the art after receiving the teachings of the present disclosure without departing from the scope thereof.

What is claimed is:

1. A sheet conveying device comprising:

upstream and downstream rotatable conveying means respectively located on an upstream side and a downstream side on a preselected sheet conveyance path;

first and second drive means for respectively causing said upstream and downstream conveying means to rotate, said second drive means driving said downstream conveying means at a variable conveying speed; and speed adjusting means for causing a conveying speed of said upstream conveying means to reflect the conveying speed of said downstream conveying means that is variable.

2. The device as claimed in claim 1, wherein said speed adjusting means comprises a first one-way clutch intervening between said upstream conveying means and said first drive means and a second one-way clutch intervening between said upstream conveying means and said downstream conveying means.

3. The device as claimed in claim 2, further comprising power transmitting means, wherein said first one-way clutch intervenes between said upstream conveying means and said first drive means for transmitting only a rotation of said first drive means that conveys a sheet in an intended direction of sheet conveyance to said upstream conveying means, and said second one-way clutch is disposed in said power transmitting means for transmitting only a rotation of said drive means that conveys the sheet at an increased speed in the intended direction of sheet conveyance to said upstream conveying means.

4. The device as claimed in claim 3, wherein said first and second one-way clutches are coaxially mounted on a single shaft included in said upstream conveying means.

5. The device as claimed in claim 3, further comprising coupling/uncoupling means intervening between said first drive means and said first one-way clutch for selectively setting up or interrupting drive transmission from said first drive means to said upstream conveying means.

6. The device as claimed in claim 5, wherein said first and second one-way clutches are coaxially mounted on a single shaft included in said upstream conveying means.

7. The device as claimed in claim 2, wherein said first and second one-way clutches are coaxially mounted on a single shaft included in said upstream conveying means.

8. The device as claimed in claim 2, further comprising coupling/uncoupling means intervening between said first drive means and said first one-way clutch for selectively setting up or interrupting drive transmission from said first drive means to said upstream conveying means.

9. The device as claimed in claim 8, wherein said first and second one-way clutches are coaxially mounted on a single shaft included in said upstream conveying means.

10. A sheet conveying device for conveying a sheet with upstream and downstream rotatable conveying means respectively located at an upstream side and a downstream side on a preselected sheet conveyance path, said sheet conveying device comprising:

drive means for causing the downstream conveying means to rotate;

acceleration drive means for accelerating a rotation of the downstream conveying means;

power transmitting means connecting said upstream and downstream conveying means; and a first one-way clutch intervening between said drive means and the downstream conveying means; and a second one-way clutch intervening between said acceleration drive means and the downstream conveying means.

11. The device as claimed in claim 10, wherein said first one-way clutch intervenes between said drive means and the downstream conveying means for transmitting a rotation of said drive means that conveys a sheet member in an intended direction of sheet conveyance to said downstream conveying means, and said second one-way clutch intervenes between said acceleration drive means and the downstream conveying means for conveying a rotation of said acceleration drive means that accelerates a conveyance of the sheet in the intended direction of conveyance to said downstream conveying means.

12. The device as claimed in claim 11, wherein said first and second one-way clutches are coaxially mounted on a single shaft included in said upstream conveying means.

13. A drive control device for controlling first and second drive means for respectively causing upstream and downstream rotatable conveying means, which are respectively located at an upstream side and a downstream side on a preselected sheet conveyance path, to rotate, said drive control device comprising:

speed adjusting means connecting the upstream and downstream conveying means for causing a conveying speed of said upstream conveying means, which is controlled by the second drive means, to reflect a conveying speed of said downstream conveying means; and control means for controlling the second drive means en such that when the conveying speed of the upstream conveying means and the conveying speed of the downstream conveying means are to be varied, said downstream conveying means rotates at a higher speed than said upstream conveying means.

14. The device as claimed in claim 13, further comprising:

first sheet sensing means for sensing a condition in which a sheet is conveyed toward the upstream conveying means; and second sheet conveying means for sensing a condition in which the sheet is conveyed toward the downstream conveying means;

wherein said control means accelerates the second drive means and then stops driving said second drive means in accordance with an output of said second sheet sensing means.

15. The device as claimed in claim 14, wherein said control means stops driving the second drive means and then stops driving the first drive means in accordance with an output of said first sheet sensing means.

16. In a drive control device for controlling drive means for causing upstream and downstream rotatable conveying means, which are respectively located at an upstream side and a downstream side on a preselected sheet conveyance path, to rotate at a preselected speed and acceleration drive means for accelerating a rotation of said upstream conveying means and a rotation of said downstream conveying means, power transmitting means connects said upstream and downstream conveying means, a first one-way clutch intervenes between said drive means and said downstream conveying means, a second one-way clutch intervenes between said acceleration drive means and said downstream conveying means, and control means controls said acceleration drive means when a conveying speed of said upstream conveying means and a conveying speed of said downstream conveying means are to be varied.

17. A duplex copy conveying unit comprising:

a reversing section for reversing a sheet;

a path for receiving the sheet conveyed from said reversing section;

at least upstream and downstream rotatable conveying means respectively located at an upstream side and a downstream side on said path for conveying the sheet from said path to an outside of said path;

first and second drive means for respectively causing said upstream and downstream conveying means to rotate, wherein said second drive means drives said downstream conveying means at a variable conveying speed; and speed adjusting means for causing said upstream conveying means to reflect a conveying speed of said downstream conveying means, which is variable.

18. The unit as claimed in claim 17, wherein said speed adjusting means comprises:

a first one-way clutch intervening between said upstream conveying means and said first drive means; and a second one-way clutch intervening between said upstream conveying means and said downstream conveying means.

19. The unit as claimed in claim 18, wherein said speed adjusting means further comprises power transmitting means connecting said upstream and downstream conveying means, said first one-way clutch intervenes between said upstream conveying means and said first drive means for transmitting only a rotation of said first drive means that conveys the sheet in an intended direction of sheet conveyance to said upstream conveying means, and said second one-way clutch is disposed in said power transmitting means for transmitting a rotation of said second drive means that accelerates a conveyance of the sheet in the intended direction of sheet conveyance to said upstream conveying means.

20. The unit as claimed in claim 19, wherein said first and second one-way clutches are coaxially mounted on a single shaft included in said upstream conveying means.

21. The unit as claimed in claim 19, further comprising coupling/uncoupling means intervening between said first drive means and said first one-way clutch for selectively setting up or interrupting drive transmission from said first drive means to said upstream conveying means.

22. The unit as claimed in claim 21, wherein said first and second one-way clutches are coaxially mounted on a single shaft included in said upstream conveying means.

23. The unit as claimed in claim 18, wherein said first and second one-way clutches are coaxially mounted on a single shaft included in said upstream conveying means.

24. The unit as claimed in claim 18, further comprising coupling/uncoupling means intervening between said first drive means and said first one-way clutch for selectively setting up or interrupting drive transmission from said first drive means to said upstream conveying means.

25. The unit as claimed in claim 24, wherein said first and second one-way clutches are coaxially mounted on a single shaft included in said upstream conveying means.

26. A duplex copy conveying unit comprising:

a reversing section for reversing a sheet;

a path for receiving the sheet conveyed from said reversing section;

at least upstream and downstream rotatable conveying means respectively located at an upstream side and a downstream side on said path for conveying the sheet from said path to an outside of said path;

drive means for causing said downstream conveying means to rotate;

acceleration drive means for acceleration a rotation of said downstream conveying means;

power transmitting means connecting said upstream and downstream conveying means;

a first one-way clutch intervening between said drive means and said downstream conveying means; and a second one-way clutch intervening between said acceleration drive means and said downstream conveying means.

27. The unit as claimed in claim 26, wherein said first one-way clutch intervenes between said drive means and said downstream conveying means for transmitting a rotation of said drive means that conveys the sheet in an intended direction of sheet feed to said downstream conveying means, and said second one-way clutch intervenes between said acceleration drive means and said downstream conveying means for transmitting a rotation of said acceleration drive means that conveys the sheet in the intended direction of sheet feed to said downstream conveying means.

28. The unit as claimed in claim 27, wherein said first and second one-way clutches are coaxially mounted on a single shaft included in said upstream conveying means.

29. In an image forming apparatus for forming an image on a sheet that is conveyed by a sheet conveying device arranged in said image forming apparatus, said sheet conveying device comprising:

upstream and downstream rotatable conveying means respectively located on an upstream side and a downstream side on a preselected path for conveying a sheet;

first and second drive means for respectively causing said upstream and downstream conveying means to rotate, said second drive means driving said downstream conveying means at a variable conveying speed; and speed adjusting means for causing a conveying speed of said upstream conveying means to reflect the conveying speed of said downstream conveying means that is variable.

30. In an image forming apparatus for forming an image on a sheet that is conveyed by a sheet conveying device arranged in said image forming apparatus, said sheet conveying device comprising:

upstream and downstream rotatable conveying means respectively located on an upstream side and a downstream side on a preselected path for conveying a sheet;

drive means for causing the downstream conveying means to rotate;

acceleration drive means for accelerating a rotation of the downstream conveying means;

power transmitting means connecting said upstream and downstream conveying means; and a first one-way clutch intervening between said drive means and the downstream conveying means; and a second one-way clutch intervening between said acceleration drive means and the downstream conveying means.

31. In an image forming apparatus including a drive control device for controlling rotations of at least two sets of conveying means for conveying a sheet on which an image is to be formed, said drive control device comprising:

speed adjusting means connecting the upstream and downstream conveying means for causing a conveying speed of said upstream conveying means, which is controlled by the second drive means, to reflect a conveying speed of said downstream conveying means; and control means for controlling the second drive means such that when the conveying speed of the upstream conveying means and the conveying speed of the downstream conveying means are to be varied, said downstream conveying means rotates at a higher speed than said upstream conveying means.

32. In an image forming apparatus including a drive control device for controlling rotations of at least two sets of conveying means for conveying a sheet on which an image is to be formed, said drive control device comprising:

power transmitting means connects said upstream and downstream conveying means;

a first one-way clutch intervening between said drive means and said downstream conveying means;

a second one-way clutch intervening between said acceleration drive means and said downstream conveying means; and control means for controlling said acceleration drive means when a conveying speed of said upstream conveying means and a conveying speed of said downstream conveying means are to be varied.

33. In an image forming apparatus for reversing and conveying a sheet carrying an image thereon by using a duplex copy conveying unit, said duplex conveying unit comprising:

a reversing section for reversing a sheet;

a path for receiving the sheet conveyed from said reversing section;

at least upstream and downstream conveying means respectively located at an upstream side and a downstream side on said path for conveying the sheet from said path to an outside of said path;

first and second drive means for respectively causing said upstream and downstream conveying means to rotate, wherein said second drive means drives said downstream conveying means at a variable conveying speed; and speed adjusting means for causing said upstream conveying means to reflect a conveying speed of said downstream conveying means, which is variable.

34. In an image forming apparatus for reversing and conveying a sheet carrying an image thereon by using a duplex copy conveying unit, said duplex conveying unit comprising:

a reversing section for reversing a sheet;

a path for receiving the sheet conveyed from said reversing section;

at least upstream and downstream conveying means respectively located at an upstream side and a downstream side on said path for conveying the sheet from said path to an outside of said path;

drive means for causing said downstream conveying means to rotate;

acceleration drive means for acceleration a rotation of said downstream conveying means;

power transmitting means connecting said upstream and downstream conveying means;

a first one-way clutch intervening between said drive means and said downstream conveying means; and a second one-way clutch intervening between said acceleration drive means and said downstream conveying means.

35. In a sheet conveying method for conveying a sheet by causing first and second drive means to respectively drive upstream and downstream rotatable conveying means, which are respectively located at an upstream side and a downstream side on a preselected sheet conveyance path, when said sheet extends over both of said upstream and downstream conveying means, said first drive means and said upstream conveying means are caused slip on each other while said second drive means causes said downstream conveying means at a higher speed than said upstream conveying means, and an increased rotation speed of said downstream conveying means is transmitted to said upstream conveying means to thereby equalize a rotation speed of said upstream conveying means and a rotation speed of said downstream conveying means, whereby a conveyance of the sheet is accelerated.

36. In a drive control method for controlling a conveying speed of upstream conveying means and a conveying speed of downstream rotatable conveying means, which are respectively located at an upstream side and a downstream side on a preselected sheet conveyance path, first and second drive means respectively causing said upstream and downstream conveying means to rotate, when a sheet extends over both of said upstream and downstream conveying means, said first drive means and said upstream conveying means are caused to slip on each other while said second drive means rotates said downstream conveying means at a higher speed than said upstream conveying means, an increased rotation speed of said downstream conveying means is transmitted to said upstream conveying means to thereby increase a conveying speed of said upstream conveying means.

37. A sheet conveying device for conveying a sheet, comprising:

upstream and downstream rotatable conveying means respectively located at an upstream side and a downstream side on a preselected sheet conveyance path;

first and second drive means for respectively causing said upstream and downstream conveying means to rotate;

power transmitting means connecting said upstream and downstream conveying means;

a first one-way clutch intervening between said upstream conveying means and said first drive means for transmitting only a rotation of said first drive means that conveys a sheet in an intended direction of sheet conveyance to said upstream conveying means;

a second one-way clutch disposed in said power transmitting means for transmitting a rotation of said second drive means that accelerates a conveyance of the sheet in the intended direction of sheet conveyance to said upstream conveying means; and delaying means for delaying rotation transmission from said second drive means to said upstream conveying means.

38. The device as claimed in claim 37, wherein said delaying means comprises:

a first engaging member rotatably integrally with said power transmitting means; and a second engaging member rotatable integrally with said second one-way clutch.

39. The device as claimed in claim 37, further comprising torque increasing means for increasing a force that causes said upstream conveying means to rotate in the event of rotation transmission from said second drive means to said upstream conveying means.

40. The device as claimed in claim 37, further comprising delay adjusting means for selectively varying a delay of the rotation transmission from said second drive means to said upstream conveying means.

41. The device as claimed in claim 40, whereon said delay adjusting means comprises:

a first engaging member rotatable integrally with said power transmitting means and including a plurality of engaging portions;

a second engaging member engageable with said plurality of engaging portions and rotatable integrally with said second one-way clutch; and moving means for selectively moving said second engaging member relative to said first engaging member.

42. A duplex copy conveying unit comprising:

a reversing section for revering a sheet;

a path for receiving the sheet conveyed from said reversing section;

at least upstream and downstream conveying means respectively located at an upstream side and a downstream side on said path for conveying the sheet from said path to an outside of said path;

power transmitting means connecting said upstream and downstream conveying means;

a first one-way clutch intervening between said upstream conveying means and said first drive means for transmitting only a rotation of said first drive means that conveys a sheet in an intended direction of sheet conveyance to said upstream conveying means;

a second one-way clutch disposed in said power transmitting means for transmitting a rotation of said second drive means that accelerates a conveyance of the sheet in the intended direction of sheet conveyance to said upstream conveying means; and delaying means for delaying rotation transmission from said second drive means to said upstream conveying means.

43. The unit as claimed in claim 42, wherein said delaying means comprises:

a first engaging member rotatably integrally with said power transmitting means; and a second engaging member rotatable integrally with said second one-way clutch.

44. The unit as claimed in claim 42, further comprising torque increasing means for increasing a force that causes said upstream conveying means to rotate in the event of rotation transmission from said second drive means to said upstream conveying means.

45. The unit as claimed in claim 42, further comprising delay adjusting means for selectively varying a delay of the rotation transmission from said second drive means to said upstream conveying means.

46. The unit as claimed in claim 45, whereon said delay adjusting means comprises:

a first engaging member rotatable integrally with said power transmitting means and including a plurality of engaging portions;

a second engaging member engageable with said plurality of engaging portions and rotatable integrally with said second one-way clutch; and moving means for selectively moving said second engaging member relative to said first engaging member.

47. In an image forming apparatus for forming an image on a sheet that is conveyed by a sheet conveying device, said sheet conveying device comprising:

upstream and downstream rotatable conveying means respectively located at an upstream side and a downstream side on a preselected sheet conveyance path;

first and second drive means for respectively causing said upstream and downstream conveying means to rotate;

power transmitting means connecting said upstream and downstream conveying means;

a first one-way clutch intervening between said upstream conveying means and said first drive means for transmitting only a rotation of said first drive means that conveys a sheet in an intended direction of sheet conveyance to said upstream conveying means;

a second one-way clutch disposed in said power transmitting means for transmitting a rotation of said second drive means that accelerates a conveyance of the sheet in the intended direction of sheet conveyance to said upstream conveying means; and delaying means for delaying rotation transmission from said second drive means to said upstream conveying means.

48. In an image forming apparatus for reversing and conveying a sheet carrying an image thereon by using a duplex copy conveying unit, said duplex copy conveying unit comprising:

a reversing section for revering a sheet;

a path for receiving the sheet conveyed from said reversing section;

at least upstream and downstream conveying means respectively located at an upstream side and a downstream side on said path for conveying the sheet from said path to an outside of said path;

power transmitting means connecting said upstream and downstream conveying means;

a first one-way clutch intervening between said upstream conveying means and said first drive means for transmitting only a rotation of said first drive means that conveys a sheet in an intended direction of sheet conveyance to said upstream conveying means;

a second one-way clutch disposed in said power transmitting means for transmitting a rotation of said second drive means that accelerates a conveyance of the sheet in the intended direction of sheet conveyance to said upstream conveying means; and delaying means for delaying rotation transmission from said second drive means to said upstream conveying means.

49. In a sheet conveying method for conveying a sheet by causing first and second drive means to respectively drive upstream and downstream rotatable conveying means, which are respectively located at an upstream side and a downstream side on a preselected sheet conveyance path, when said sheet extends over both of said upstream and downstream conveying means, said first drive means and said upstream conveying means are caused to slip on each other while said second drive means causes said downstream conveying means at a higher speed than said upstream conveying means, and an increased rotation speed of said downstream conveying means is transmitted to said upstream conveying means after being delayed to thereby equalize a rotation speed of said upstream conveying means and a rotation speed of said downstream conveying means, whereby a conveyance of the sheet is accelerated.

* * * * *